US009523276B2

(12) United States Patent
Genissieux et al.

(10) Patent No.: US 9,523,276 B2
(45) Date of Patent: Dec. 20, 2016

(54) MULTIFUNCTION ROTARY MACHINE WITH DEFORMABLE RHOMB

(75) Inventors: Vincent Genissieux, Grenoble (FR); Jean-Thomas Collomb, Eybens (FR)

(73) Assignee: Vincent Genissieux, Grenoble (FR)

( * ) Notice: Subject to any disclaimer, the term of this patent is extended or adjusted under 35 U.S.C. 154(b) by 823 days.

(21) Appl. No.: 13/120,267

(22) PCT Filed: Sep. 22, 2009

(86) PCT No.: PCT/FR2009/001119

§ 371 (c)(1),
(2), (4) Date: Jun. 10, 2011

(87) PCT Pub. No.: WO2010/031927

PCT Pub. Date: Mar. 25, 2010

(65) Prior Publication Data

US 2011/0236240 A1 Sep. 29, 2011

(30) Foreign Application Priority Data

Sep. 22, 2008 (FR) ..... 08 05177

(51) Int. Cl.
*F01C 1/44* (2006.01)
*F01C 11/00* (2006.01)

(52) U.S. Cl.
CPC ..... *F01C 1/44* (2013.01); *F01C 11/004* (2013.01)

(58) Field of Classification Search
USPC ..... 123/241
See application file for complete search history.

(56) References Cited

U.S. PATENT DOCUMENTS 3,196,854 A 7/1965 Novak
3,295,505 A 1/1967 Jordan
3,387,596 A 6/1968 Niemand
(Continued)

FOREIGN PATENT DOCUMENTS

CA 997998 10/1976
DE 2145768 A1 * 3/1973 ..... F01C 1/40
(Continued)

OTHER PUBLICATIONS

WO2008107547 English Translation.*
International Search Report as issued for PCT/FR2009/001119, dated Dec. 23, 2009.

*Primary Examiner* — Thomas Denion
*Assistant Examiner* — Jessica Kebea

(57) ABSTRACT

A rotary machine with a deformable rhomb, includes a housing defining a stator for receiving a rotor which is a deformable rhomb in contact, with or without clearance, with the internal surface of the housing, the deformable rhomb including several pistons connected one after the other by a pivotal hinge having an axis parallel to the longitudinal axis of the housing and thus defining a closed chain; the internal surface of the housing of the machine defining an external cavity, with the exterior of the deformable rhomb, and with the lateral closure flanges of the housing, and an inner cavity being formed in the interior of the rotor with the lateral closure flanges of the housing; at least one of the external cavities and/or at least one of the inner cavities being connected, directly or indirectly, to the inlet of a fluid circuit external to the machine.

9 Claims, 15 Drawing Sheets

(56) References Cited

U.S. PATENT DOCUMENTS

| | | | | |
|---|---|---|---|---|
| 5,288,217 | A | 2/1994 | Contiero | |
| 5,419,292 | A * | 5/1995 | Antonov | 123/241 |
| 6,164,263 | A * | 12/2000 | Saint-Hilaire et al. | 123/241 |
| 6,722,321 | B2 * | 4/2004 | Kim | 123/43 R |
| 7,178,502 | B2 * | 2/2007 | Okulov | 123/241 |
| 8,904,991 | B2 * | 12/2014 | Al-Hawaj | F02B 55/14 123/200 |
| 8,951,028 | B2 * | 2/2015 | Genissieux | F01C 1/324 123/241 |
| 2002/0189578 | A1 * | 12/2002 | Szorenyi | F01C 1/22 123/241 |
| 2004/0079321 | A1 | 4/2004 | Saint-Hilaire et al. | |
| 2005/0260092 | A1 * | 11/2005 | Bolger | 418/142 |
| 2012/0269618 | A1 * | 10/2012 | Curodeau | F01C 1/44 415/182.1 |
| 2014/0140879 | A1 * | 5/2014 | Al-Hawaj | F02B 55/14 418/117 |

FOREIGN PATENT DOCUMENTS

| | | | | |
|---|---|---|---|---|
| EP | 1 092 838 | | 4/2001 | |
| EP | 1 295 012 | B1 | 3/2003 | |
| FR | 1 404 453 | | 2/1964 | |
| FR | 2 145 133 | | 2/1973 | |
| FR | 2 493 397 | | 5/1982 | |
| FR | 2 911 631 | | 7/2008 | |
| FR | WO 2008107547 | A1 * | 9/2008 | F01C 1/40 |
| WO | WO 86/00370 | | 1/1986 | |
| WO | WO 01/88341 | | 11/2001 | |
| WO | WO 2004/070169 | | 8/2004 | |
| WO | WO 2005/106204 | | 11/2005 | |

* cited by examiner

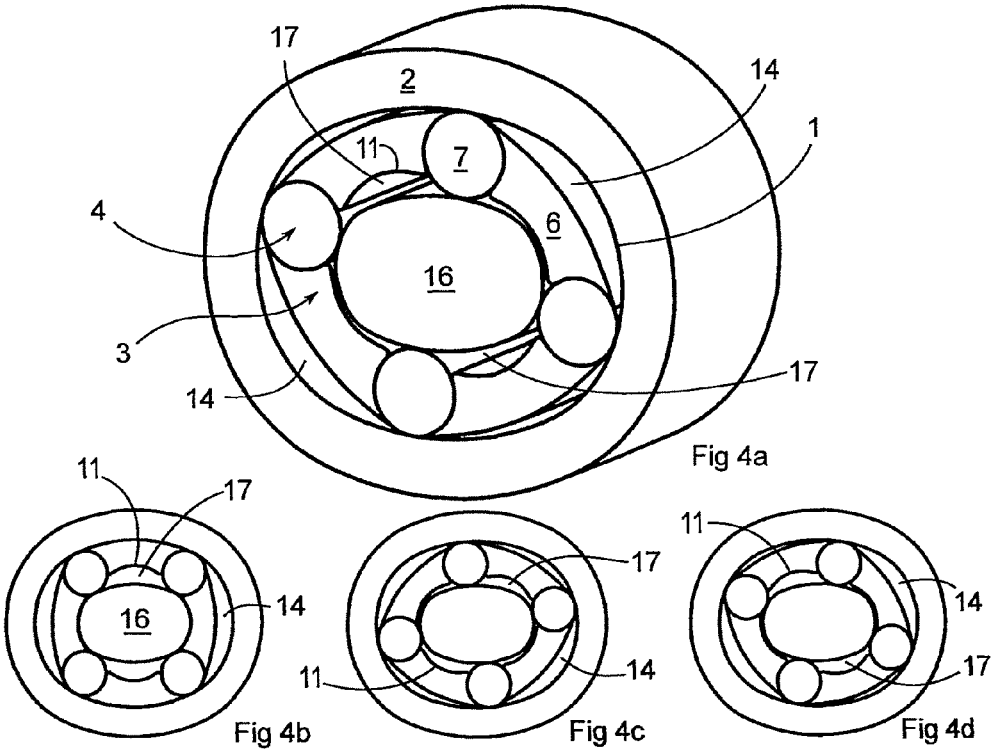
Fig 4a
Fig 4b
Fig 4c
Fig 4d
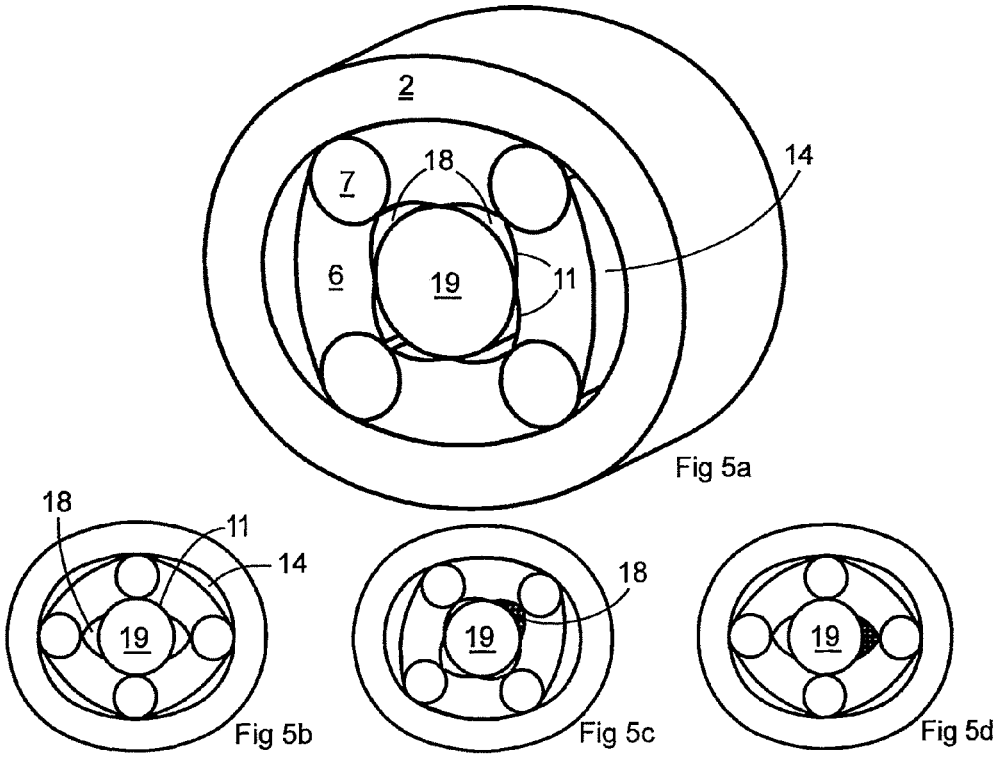
Fig 5a
Fig 5b
Fig 5c
Fig 5d

MULTIFUNCTION ROTARY MACHINE WITH DEFORMABLE RHOMB

CROSS REFERENCE TO RELATED APPLICATIONS

This application is the U.S. National Stage of PCT/FR2009/001119, filed Sep. 22, 2009, which in turn claims priority to French Application No. 0805177, filed Sep. 22, 2008. The content of both applications are incorporated herein by reference in their entirety.

FIELD OF THE INVENTION

The present invention concerns a rotary machine with a deformable rhomb. Such a machine generally comprises a fixed assembly, usually called stator, and a mobile assembly, usually called rotor, having a rhomb shape articulated at its summits and turning around its centre, able to be deformed during its rotation. Each side of the rhomb determines with the internal profile of the stator having a general oval shape, a variable-volume chamber during the movement of the rotor. The sides of the articulated rhomb are realized by plates, designated pistons, having for the most part an exterior surface of curvilinear shape. These pistons are sometimes provided, in their contact zone with the internal profile of the stator, with tightness segments.

Such a machine can be used as a combustion engine, turbine, compressor, pump, fan, etc. It presents the advantage of having a fixed centre of gravity, thus being able to avoid vibrations, of being able to reach compressions equivalent to those of piston motors, of having a greater flow than piston motors, of having a greater pressure ratio than turbines and of being simpler than the majority of the generally known machines fulfilling the same functions.

PRIOR ART

Rotary machines with a deformable rhomb (RMDR) have a stator generally constituted by a non-circular cylindrical housing (understood to be a cylinder, the guiding curve of which is not a circle) exterior to the rotor in the shape of a rhomb and a plurality (most frequently four) of rotary elements articulated with each other at the level of their adjacent edges according to a pivot connection of an axis parallel to the longitudinal axis of the housing, each of the rotary elements delimiting with the inner wall of the housing a chamber or cavity of variable volume. These machines have been described for a long time, but they are scarcely used. In the manner of the Wankel engine, which is well known to the man skilled in the art, these machines had been firstly imagined as a combustion engine. The patent FR 1 404 453 (J. Lemaitre), the U.S. Pat. No. 3,196,854 (A. Novak), the patent FR 2 145 133 (J. Martin Artajo), the patent application WO 01/88341 (P. Szorenyi), the patent CA 997998 (E. Steinbrink) and the patent application FR 2 493 397 (J. P. Ambert) describe the idea and the theoretical conception of such an engine. The patent application WO 2004/070169 (G. Saint-Hilaire) describes a rotary internal combustion engine with a deformable rhomb, detailing its structure, but without explaining how its tightness is ensured under the operating conditions of a combustion engine, and without detailing, either, the materials suited to holding the pressures and temperatures in such a machine, or giving solutions concerning the expansion of the materials or the compensation of functional clearances. Other combustion engines of the RMDR type are described for example in the documents EP 1 295 012 B1 (Nivesh S A) and U.S. Pat. No. 3,387,596 (L. Niemand).

It was recognized very soon that the RMDRs can also serve as pumps. This is described for example in the U.S. Pat. No. 3,295,505 (A. Jordan) and EP 1 092 838 A2 (J. Sanchez Talero) and in the patent applications WO 86/00370 (I. Contiero) and WO 2005/106204 (P. Okulov). More particularly, the document WO 86/00370 describes a concept of RMDR comprising four variable-volume external chambers, defined between the external surface of the rotor, the internal surface of the stator, and also a variable-volume inner chamber defined in the interior of the deformable rotor, these chambers being delimited axially by two lateral closure flanges. In a variant, a same fluid is conveyed between the inner chamber functioning as a compressor and the external chambers functioning as a motor.

A RMDR has several cavities which are more or less independent and which can be used in different ways. Patent application FR 2 911 631 (Ph. Kuzdzal) describes a combustion engine or pressurized gas injection engine having, in addition to external cavities limited by the interior wall of the housing and the articulated rotary elements, four inner cavities each delimited by the interior walls of adjacent rotary elements and the exterior ones of a central shaft. In addition, the engine comprises two other inner cavities each situated at the level of an articulation between two mobile elements, intended to lubricate the articulation segments. The lubricating oil can also be used to cool the engine and, in this case, the inner cavities communicate with each other by being connected by ducts for the circulation of the oil. The oil is brought in an internal lubrication/cooling circuit of the engine by a pump, the inner cavities being used solely to open and close the check valves of the internal circuit of the engine, allowing the combustion engine to be cooled in a closed circuit. It is to be noted that the variation in volume of the inner cavities during a complete cycle of the machine is small, but probably sufficient for a closed-circuit operation of the lubricant.

The patent application WO 2004/070169, which has already been mentioned, raises the possibility of using the inner cavities as a pump, whilst the external cavities serve as a combustion engine, and also the possibility of using the external cavities as a pump or compressor, whilst the inner cavities are used as an engine. No actual embodiment is given to illustrate these concepts.

The problem which the present invention aims to solve is to present a compact and simple device, comprising a minimum of mobile parts, which allows different functions for processing a fluid to be carried out at the same time.

Another aim of the invention is to propose a rotary machine with a deformable rhomb which is able to exchange one or several fluids with one or more circuits external or internal to the machine, so as to vary the dynamic parameters and/or pressure parameters of at least one fluid, in a manner which is simple and reliable over time.

Another aim of the invention is to propose a rotary machine with a deformable rhomb which is able to exchange one or several fluids with one or more circuits external or internal to the machine, so as to vary the dynamic parameters and/or pressure parameters of at least one fluid, in an autonomous manner, without driving by an external mechanical system of its components.

Another aim of the invention is to propose a rotary machine with a deformable rhomb having a power density and/or a density of functions greater than the known RMDR machines.

OBJECT OF THE INVENTION

The aim of the invention is achieved with a rotary machine with a deformable rhomb comprising a housing forming a stator able to receive a rotor which is a deformable rhomb which is situated, directly or indirectly (by means of a sealing device or the external surface of a pivotal hinge) in sliding or rolling contact, with or without clearance, with the internal surface of the housing, the said deformable rhomb including a plurality of pistons, preferably four pistons, connected one after the other by a pivotal hinge having an axis parallel to the longitudinal axis of the housing and thus forming a closed chain; the internal surface of the housing of the said machine defining at least one cavity so-called external cavity, with the extrados of at least one of the said pistons, and with the closing side walls of the housing, and at least one cavity so-called inner cavity being formed inside the rotor with the closing side walls of the housing; at least one of the external cavities and/or at least one of the inner cavities being connected, directly or indirectly (for example by means of check valves or valves), to the inlet of at least one fluid circuit outside the machine, given that the said external and inner cavities include together at least three variable-volume cavities capable of fulfilling at least three different functions simultaneously, (in other words: these functions are carried out in parallel within the machine), or at least three identical functions successively (in other words: these functions are carried out in series within the machine), or at least three functions at least one of which is different from the other two and is carried out simultaneously (in other words: in parallel) with the other two functions which are identical and carried out successively (in other words: in series), each of the said functions being selected from those of: combustion engine, fluid expansion turbine, fluid compressor, pump, measuring device, mixer, flow distributor, energy converter, grinder, so as to modify at least one of the parameters of the fluid exiting the machine relative to the incoming fluid.

The machine of the invention is therefore able to ensure at least three functions, different or identical, in parallel or in series, or at least one in parallel with two others in series, within at least three variable-volume cavities distributed in cavities internal to the rhomb, or in cavities external and internal to the rhomb, in particular by means of exchange zones, the said functions each being selected from: combustion engine, turbine, compressor, pump, measuring device, mixer, flow distributor, energy converter, grinder, so as to modify at least one of the parameters of the fluid exiting the machine relative to the incoming fluid.

Thus, the machine is able to exchange at least one fluid with an external circuit by at least one of the external cavities and/or by at least one of the inner cavities. An external circuit is understood to mean a circuit which is different from a closed circuit belonging to or internal to the machine, such as a closed lubrication or cooling circuit of the elements of the machine itself.

A variable-volume cavity is a space delimited by the components of the machine, a space of which the volume varies on the relative movement of the rotor with respect to the stator. Thus, this can be achieved with a deformation of the rhomb when it turns inside the fixed housing of the stator. The objects of the invention are also achieved when the functions of rotor and stator are reversed, or when the stator is a non-circular cylindrical profile internal to the rhomb. Indeed, if the rhomb deforms without turning, this will cause the rotation of the external housing. According to the terms of the invention, a variable-volume cavity is understood to mean a cavity associated with a fluid circuit having a function which is distinct from that of the other cavities. Thus, according to the invention, a variable-volume cavity can be used on a fluid circuit which is independent of that of the other cavities (for example, with four external cavities and four fluid circuits independent of each other, one can obtain four distinct functions of the machine). Still according to the invention, a variable-volume cavity can be associated with a transformation stage of one or several parameters of the fluid belonging to a fluid circuit passing successively through several cavities. More precisely, when a fluid circuit passes in several stages through the variable-volume cavities of the machine, one variable-volume cavity (or sometimes two or several cavities can be connected since they fulfil the same function at the same time (one understands identity of the parameters of the fluid processed by the cavity)) is then associated with one transformation stage of the parameters of the fluid passing through it.

According to the invention, several cavities having variable-volume geometries are realized within the same machine, between the stator and the rotor, and also inside the rotor, so that at least three of these cavities can function simultaneously (where simultaneously is understood to mean that the functions are realized in parallel), or successively (where successively is understood to mean that the functions are realized in series) as a combustion engine, fluid expansion turbine, fluid compressor, pump, measuring device, mixer, flow distributor, energy converter, grinder, and this being either independently or being linked by an exchange of fluid. Thus, the value of at least one parameter of the fluid which enters into the machine is different from that of the same parameter of the fluid which leaves the machine, by being transformed on the passage of the fluid through one or several variable-volume cavities of the machine, several passages through cavities of the machine being able to lead to several changes of the values of one or several parameters of the fluid.

Function is understood to mean the action of modification (in the sense of processing) of at least one parameter of a fluid, of whatever nature (gaseous, liquid, mixture, Newtonian, non-Newtonian, gel, plasma, paste . . . ) in the course of a given operating cycle in the machine.

Operating cycle is understood to mean the cyclic and defined variation of the volume of a cavity of the machine.

Parameter of the fluid, compressible or not, is understood to mean any physico-chemical, quantifiable and measurable parameter, of a nature so as to characterize this fluid and/or its state, such as for example: the pressure, the temperature, the velocity, the vorticity, the chemical composition (in the case of fuels, detergent . . . ), the viscosity, the shearing rate (in the case of alimentary pastes), the granulometry (in the case of crushing . . . ), the homogeneity (in the case of mixing, of mixture under centrifugation . . . ), the concentration . . . .

A rotary machine with a deformable rhomb according to the invention allows a power density to be provided which is greater than the known RMDR machines. Power density is understood to mean the useful power of the machine per unit of volume of the overall dimensions of this machine. Advantageously, the use of several variable-volume cavities successively (in series) within the same machine allows a processing function of a same fluid to be realized overall in several sub-functions of the same nature and operating over different ranges of variation of at least one of the parameters of this fluid.

Within the framework of the present invention, the following definitions are used:

Longitudinal axis is understood to mean the rotation axis of the machine parallel to the directing line of the housing (1). The housing is generally symmetrical with respect to this longitudinal axis.

Pump is understood to mean a machine consuming mechanical energy to increase the static or dynamic pressure energy of a fluid (liquid or gaseous). This comprises hydraulic pumps, pneumatic pumps, vacuum pumps, turbo-pumps, centrifugal pumps, axial pumps, fans and propulsion propellers, etc.

Turbine is understood to mean a machine consuming the static or dynamic pressure energy of a fluid (liquid or gaseous) to increase the mechanical energy. This comprises hydraulic motors, pneumatic motors, vacuum motors, turbines, centrifugal turbines, axial turbines, wind turbines and marine turbines, etc.

Fluid measuring device is understood to mean a machine, the flow of which is directly linked to the speed of rotation.

Mixer is understood to mean a machine capable of mixing fluids which are different from each other by their composition, their temperature, their pressure, their physico-chemical state, their purity, their homogeneity, etc.

Flow distributor of one or several fluids is understood to mean a machine generating several flows which are linked to each other.

Energy converter is understood to mean a machine which converts the pressure energy or the dynamic energy of a fluid into mechanical energy, or vice versa.

Grinder is understood to mean a machine capable of grinding a solid or semi-solid material, being able for example to be in suspension in a fluid.

The machine of the invention can thus fulfil at least three different functions simultaneously, or in parallel, at least one of which can be a motive function, within 3 distinct variable-volume cavities. One thus obtains three or several devices using the thermodynamic parameters of one or several fluids which are integrated in a single machine, by using in a judicious manner the volumes of variable geometry created inside the machine during the deformation of the rhomb resulting from a relative movement between the rotor and the stator of the machine (more particularly, the pistons of the rotor have a movement of rotation around the longitudinal axis of the housing and a movement of rotation around the centre of the sides of the rhomb).

Thus, the variations in speed and/or in pressure and/or in temperature of a fluid admitted into the machine can cause the rotation of the rhomb, or conversely, the rotation of the rhomb can cause the variations in speed and/or in pressure and/or in temperature of a fluid admitted into the machine, before its discharge, the rotation of the rhomb which, owing to the variation of the volume of the inner or external cavities thus created, varies the pressure and/or the temperature of a processing fluid. This variation would then be made in several stages, for example to obtain several pressure stages of the same fluid, even to use a first pressure of a fluid to initiate a pressure change of another fluid.

The machine of the invention can also fulfil at least three identical functions successively, or in series, within at least 3 distinct variable-volume cavities.

Finally, the machine of the invention can fulfil at least three functions within 3 distinct variable-volume cavities, two of these functions being identical and fulfilled successively (in series) whilst the third function is different from the first two and is fulfilled simultaneously (in parallel).

The object of the invention is also achieved with a machine functioning as a multi-pump and/or multi-turbine and/or as a multi-compressor. Thus, the rhomb can be driven by a fluid (the machine then comprises at least one turbine and at least two pumps operating in series and/or in parallel; or at least two turbines operating in series and/or in parallel associated with at least one pump) or by a motorised drive shaft, all these devices of the multi-pump or multi-turbine type being integrated in the mechanism of the same machine.

Indeed, owing to its structure with several variable-volume cavities, such a multi-functional rotary machine with a deformable rhomb allows different fluids to be used (air, water, oil, etc.) and allows the integration of several transformation functions of one or several thermodynamic parameters of the fluid or fluids used, even conversion of the energy of this fluid/these fluids, within a simplified mechanical structure and within a small dimensioning, compared with the known machines fulfilling the same functions.

A multi-pump or multi-turbine or multi-compressor operation of such a machine is applied advantageously in the case of complex hydraulic or pneumatic circuits which require regulation.

Such a machine can be used as power adapter, for example by using at the inlet a fluid with a high flow and a low pressure to obtain at the outlet a fluid having a low flow and a stronger pressure.

One can also obtain a compressor having three stages with the same machine.

Such a machine is also applied when one wishes to realize a coupling of a hydraulic circuit with a pneumatic circuit using different fluids. One can thus, for example, drive a water pump with a hydraulic motor and cool the whole of the machine with compressed air, all in the same machine.

Another example for the use of the machine is to realize dosages of foods, for example for pumping fluids of different natures (in particular in terms of viscosity, homogeneity or composition, etc. . . . ) at different flows, with each entering fluid passing through a variable-volume chamber of the same machine.

Advantageously, the machine comprises means for the transfer or exchange of fluid from one variable-volume cavity to another. These transfer or exchange means are, in particular, orifices or ducts formed in the pistons, the pivots, the lateral flanges, the profile of the housing or the transmission device.

Preferably, the external cavities are extrados peripheral cavities, each being defined between the extrados face of a piston, the internal surface of the housing and the lateral closure flanges.

According to an advantageous aspect of the invention, the external cavities are extrados circular cavities, each being defined by the extrados faces of two adjacent pistons, the pivotal hinge connecting them, the internal surface of the housing and the lateral closure flanges.

Thus, the device of the invention allows up to four external cavities to be used with the same fluid or with different fluids. By making specific adaptations within the housing or on the extrados face of each piston, for example by dividing each cavity by a vane, one can obtain more than four external cavities.

According to the invention, an inner cavity is any cavity comprised inside the rhomb. Such an inner cavity has at least one surface in common with the intrados face of at least one of the pistons or with the intrados of at least one of the pivotal hinges or with at least one intermediate part connected to one of the pistons or to one of the pivotal hinges. Advantageously according to the invention, the inner cavities, the volume of which is made to vary with the rotation of the rotor relative to the stator of the machine, are selected from: intrados peripheral cavities, intrados circular cavities, central cavities, central cavities divided by one or two diagonals, central cavities divided by one or two medians, cylindrical cavities, off-center or centered toric cavities, helicoidal cavities, or a combination of several such inner cavities.

Preferably, the said inner cavity is an intrados circular cavity formed by the space comprised between the intrados faces of two connected pistons, a circular cylinder internal to the deformable rhomb and the lateral closure flanges.

This allows one to use judiciously the variation in the volume of such a cavity formed with a circular cylinder which can be the transmission shaft of the movement of the rhomb, even the rotation drive shaft of the rhomb.

Advantageously, the said inner cavity is an off-center external toric cavity defined by the space comprised between the external surface of a sliding toric device, the ends of which rest on two connected pistons, the intrados faces of the two connected pistons, the pivotal hinge and the lateral closure flanges.

Preferably, the said inner cavity is an off-center inner toric cavity defined by the space comprised between the piston of a first toric device and the cylinder of a second complementary toric device, with the piston resting on one of the pistons and the cylinder on another piston adjacent to the first, and the lateral closure flanges.

Advantageously, the said inner cavity is a off-center central toric cavity defined by the space comprised between the central axis of the rhomb, the external surface of a toric device, the ends of which rest on two median arms of the rhomb and the lateral closure flanges.

Preferably, at least two of the said external peripheral cavities or at least two of the said inner cavities, or at least two of the external and inner cavities transport a different fluid.

Advantageously, the machine comprises zones for the exchange of fluid with the external cavities, these zones being ducts formed in the pistons, the pivots, the flanges, the profile of the housing or the transmission device.

Thus, according to a preferred embodiment, the machine of the invention uses the same working fluid which is transferred, during its operation, between one of the external cavities and one of the inner cavities.

Preferably, the machine comprises zones for the exchange of fluid with the intrados cavities, these zones being ducts formed in the pistons, the pivots, the flanges, the central shaft of the machine or the transmission device.

Advantageously, the pistons, the internal surface of the housing, the arms of the diagonals or the arms of the medians are provided with blades so that the variations of the dynamic parameters of the fluid predominate over the variations of the static parameters.

This allows the machine to accumulate the dynamic effects, due to the speed of the fluid or fluids which it conveys, and the static effects due to the pressure of the fluid or fluids conveyed by the machine. Advantageously, the variation of the dynamic parameters of the fluid is greater than the variation of the static parameters of the same fluid.

This also allows the machine to promote the thermal exchanges owing to the dynamic effects and owing to the larger heat exchange surface.

Advantageously, the machine of the invention can be reversible. For example, this offers the advantage of being able to integrate the machine in processes for the energy recovery in particular in a storage barrage where the machine can function as a turbine to produce electrical energy or as a pump to absorb the energy of the network.

According to one of the advantageous aspects of the invention, a machine comprising at least one inner cavity and at least one external cavity, or comprising at least two different inner cavities, within which the same fluid travels through, will benefit from a facility for realizing the dynamic tightness between the said cavities owing to a levelling effect of intermediate pressure.

According to one of the advantageous aspects of the invention, a machine comprising at least two variable-volume cavities, inner and/or external, which ensure successively at least two processing functions of the same nature on the same fluid, will be able to have a better isoentropic efficiency by the addition of a heat exchanger (exterior to the machine or integrated in the casing of the machine) between the two cavities. Indeed, on the multi-stage compression of a fluid, the extraction of calories from the fluid towards the exterior of the machine after each compression stage improves the overall isoentropic efficiency of the multi-stage compression. Conversely, on the multi-stage expansion of a fluid, the feed of calories to the fluid from the exterior of the machine after each expansion stage improves the overall isoentropic efficiency of the multi-stage expansion. In the particular case of a RMDR machine according to the invention, fulfilling at the same time at least one function having the effect of cooling a first fluid (typically the expansion of a gas) and at least one function having the effect of heating a second fluid (typically the compression of a gas), exchange ducts of a third coolant fluid will be able to be realized in the components of the machine, so as to transmit the calories generated in the variable-volume cavities of the second function to the variable-volume cavities of the first function, and to thus improve the overall isoentropic efficiency of the said machine.

The objects of the invention are also achieved with a pump, a turbine, a motor or a compressor comprising the characteristics of a machine of the invention.

DESCRIPTION OF THE FIGURES

FIGS. 1 to 3 illustrate the evolution of the external cavities of a machine of the invention, represented by a simplified section view, in which:

FIGS. 4 to 12 illustrate the evolution of the inner cavities of a machine of the invention, represented by a simplified section view, in which:

FIGS. 4*a* to 4*d* illustrate inner cavities according to a first variant embodiment;

FIGS. 5*a* to 5*d* illustrate inner cavities according to a second variant embodiment;

LIST OF REFERENCE NUMBERS

Figure 1A:
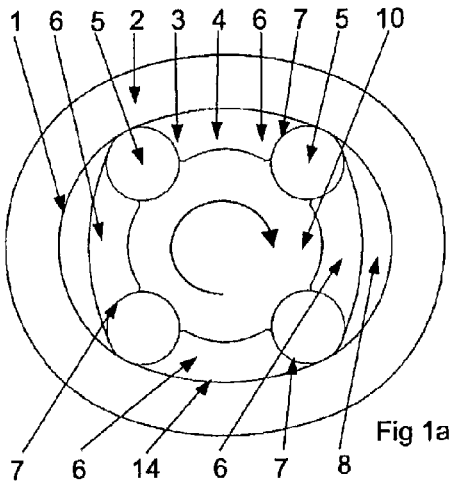
FIGS. 1*a* to 1*f* illustrate the evolution of an external left-hand cavity on a complete cycle of the rhomb.
Figure 1D:
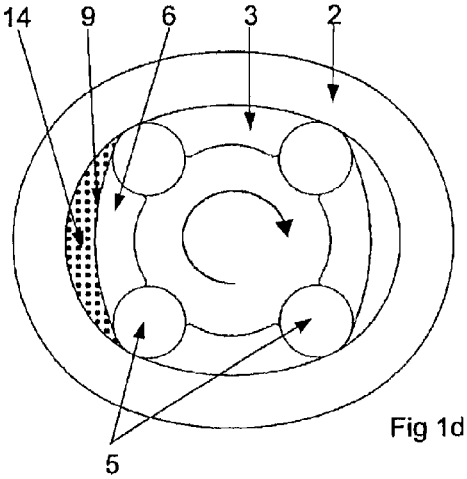
Figure 1B:
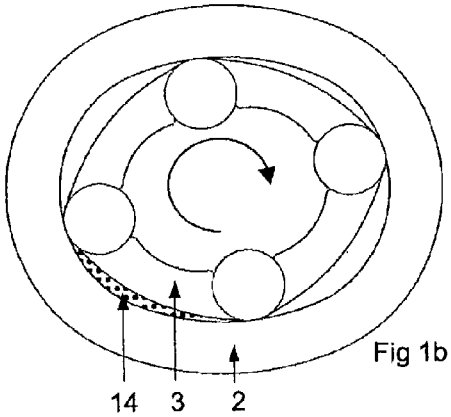
Figure 1E:
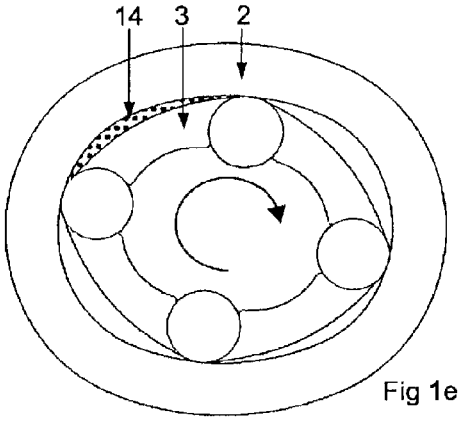
Figure 1C:
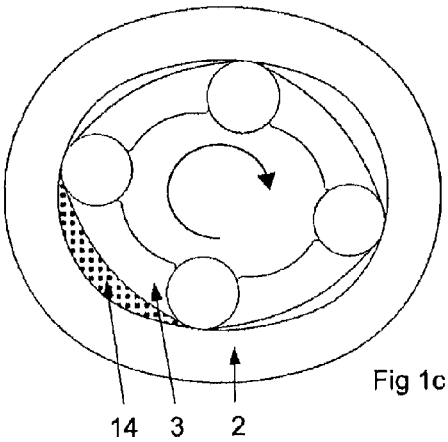
Figure 1F:
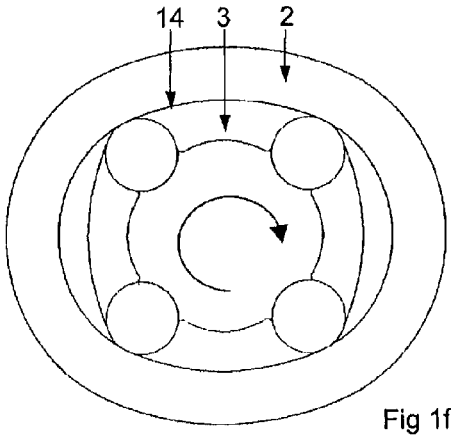
Figure 2A:
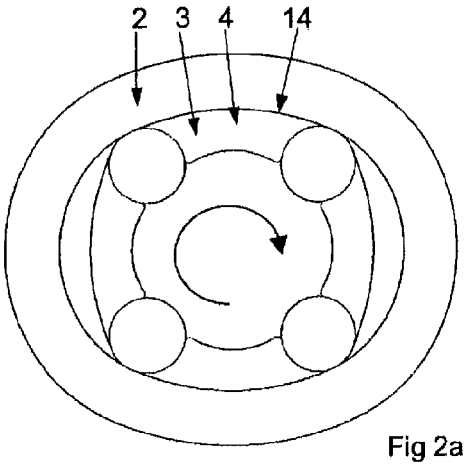
FIGS. 2*a* to 2*f* illustrate the evolution of an external right-hand cavity on a complete cycle of the rhomb.
Figure 2D:
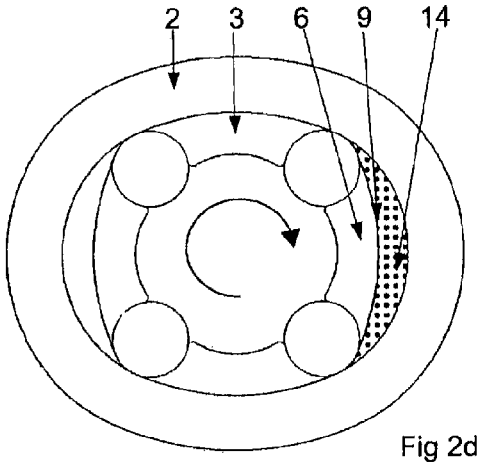
Figure 2B:
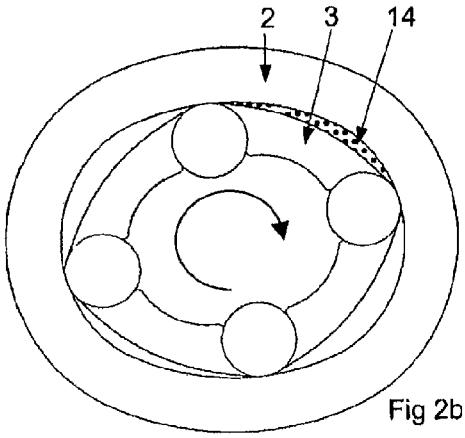
Figure 2E:
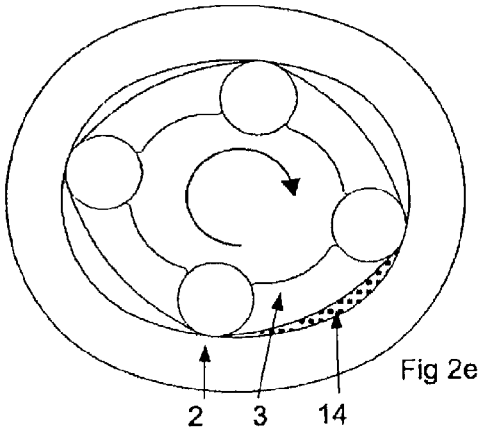
Figure 2C:
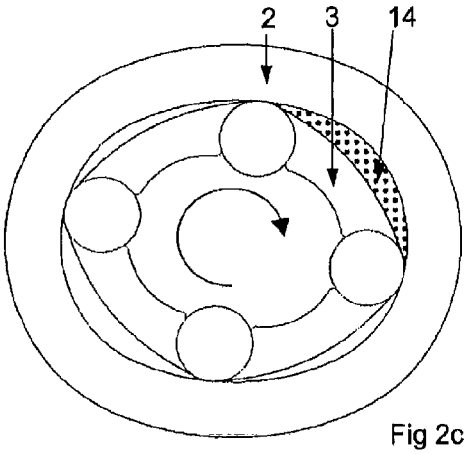
Figure 2F:
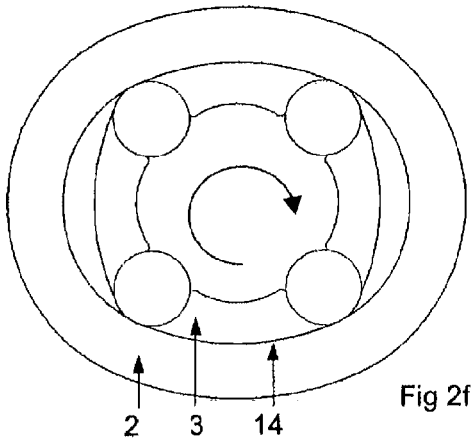
Figure 3A:
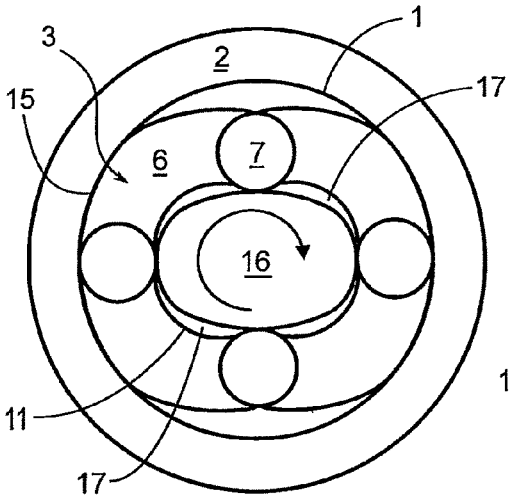
FIGS. 3*a* to 3*d* illustrate the evolution of an external cavity realized according to a variant, on a complete cycle of the rhomb.
Figure 3B:
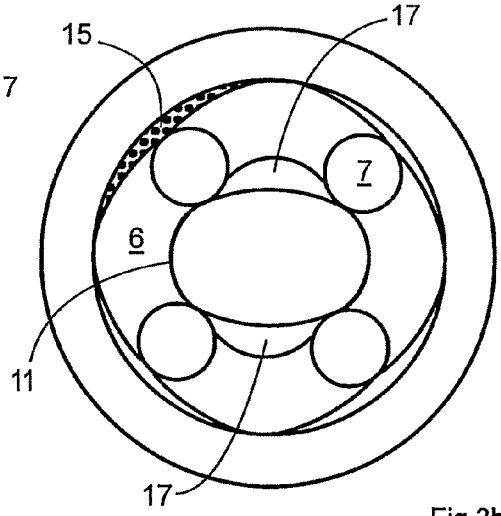
Figure 3C:
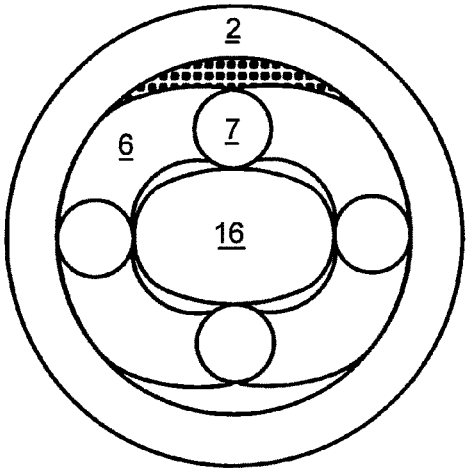
Figure 3D:
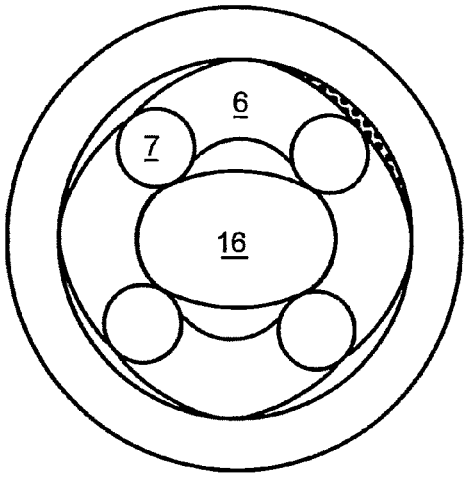

| | |
|---|---|
| 1 | housing |
| 2 | stator |
| 3 | rotor |
| 4 | deformable rhomb |
| 5 | summit of the rhomb |
| 6 | Piston |
| 7 | pivotal hinge (pivot) |
| 8 | external cavity |
| 9 | extrados face of the piston |
| 10 | inner cavity |
| 11 | intrados face of the piston |

-continued

| | |
|---|---|
| 12 | lateral flange |
| 13 | lateral flange |
| 14 | extrados peripheral cavity |
| 15 | extrados circular cavity |
| 16 | elliptical central shaft |
| 17 | intrados peripheral cavity |
| 18 | intrados circular cavity |
| 19 | circular cylinder |
| 20 | central inner cavity |
| 21 | central cavity of the rotor divided by one diagonal |
| 22 | Slide |
| 23 | cylindrical cavity of slide |
| 24 | slide cylinder |
| 25 | central cavity of the rotor divided by two diagonals |
| 26 | central cylindrical cavity |
| 27 | sliding piston |
| 28 | central cavity of the rotor divided by one median |
| 29 | central cavity of the rotor divided by two medians |
| 30 | median |
| 31 | off-center external toric cavity |
| 32 | off-center inner toric cavity |
| 33 | toric devices |
| 34 | central toric cavity |
| 35 | flexible membrane |
| 36 | end tab |
| 37 | end tab |
| 38 | bellows |
| 39 | flexible membrane wall |
| 40 | check valve orifices |
| 41 | diagonal |
| 42 | diagonal |
| 43 | extrados blades |
| 44 | intrados blades |
| 45 | stator blades |
| 46 | median arm blades |
| 47 | propeller |
| 48 | blade of diagonal arm |
| 49 | propeller |
| 50 | fixed part of blade |
| 51 | radial fluid inlet/outlet orifice |
| 52 | axial fluid inlet/outlet orifice |
| 53 | peripheral ports |
| 54 | inlet/outlet ducts in the hinges |
| 55 | inlet/outlet ducts via the pistons |
| 56, 56' | axial duct |
| 57 | (central) rotation shaft |
| 58 | first end of the rotation shaft |
| 59 | median plane outlet orifice |
| 60 | second end of the rotation shaft |
| 61 | excrescence |
| 62 | connection zone |
| 63 | internal zone |
| 64 | external zone |
| 65 | central zone |
| 66 | toric cavity |
| 67 | central cavity |
| 68 | bottom wall |
| 69 | passage |
| 70 | passage |
| 71 | half-moon air inlet |
| 72 | half-moon air outlet |
| 73 | half-moon water inlet |
| 74 | half-moon water outlet |
| 75 | axial duct |
| 76 | air inlet plate |
| 77 | air outlet plate |
| 78 | air outlet recess |
| 79 | air inlet recess |
| 80 | compressor |

DESCRIPTION OF THE INVENTION

The invention concerns a rotary machine with a deformable rhomb (RMDR) comprising a stator 2 having a general tubular shape of approximately oval section, the profile of which is consistent with the geometric rules imposed by the deformation of the rhomb during its rotation, and the internal surface of which defines a housing 1 for receiving a rotor 3 which is a deformable rhomb 4.

The deformable rhomb 4 is an assembly of four pistons 6 connected with each other by pivot connections, formed by pivotal hinges 7, and which form a chain which is closed within itself. The rotor 3 is generally the turning part of the machine, but one may, in a variant, drive the housing 1 in rotation which then turns with respect to the rhomb 4, which is fixed in rotation, but the sides of which deform (side is understood to mean the segment which connects, in a plane perpendicular to the rotation axis of the machine, the axes of two adjacent pivot connections). The projections of the axes of pivot connections of the pistons in a plane perpendicular to the rotation axis of the machine represent the summits 5 of the rhomb. The segment which connects two opposite summits 5 forms a diagonal of the rhomb.

Diagonal will be understood below to also mean a mechanical part or connection constructed according to this segment.

A piston 6 is a part having a shape of a cylinder portion with a directing line parallel to the rotation axis of the machine. The surfaces situated at the two ends of this part each ensure a part of a pivot connection with a rotation axis parallel to the rotation axis of the machine. The segment which connects two median points of the opposite sides of the rhomb, in particular of two opposite pistons, forms a median of the rhomb. Median will be understood below to also mean a mechanical part or connection constructed according to this segment.

The intersection of the diagonals or medians of the rhomb defines the centre of the machine. Rotation shaft 57 (FIG. 23) or central shaft of the machine is understood to mean a part or an assembly of mechanical parts allowing the rotation movement of the rotor or of the stator to be recovered via a suitable mechanical transmission system.

The machine also comprises two lateral closure flanges 12, 13 (FIG. 20*a*), arranged perpendicularly to the rotation shaft of the machine and which rest against the front and rear faces of the stator and of the rotor.

The extrados 9 of the piston will be understood below to mean the external surface of the piston 6, situated on the exterior of the rhomb 4, and the intrados 11 of the piston will be understood to mean the internal surface of the piston 6, situated in the interior of the rhomb 4.

Volume of the machine is understood to mean the circular cylinder closed by the lateral flanges and encompassing the external profile of the stator of the machine according to a conventional embodiment or encompassing the most off-centered part with respect to the rotation axis.

The invention uses the property of the rotary machine with a deformable rhomb provided with means of the invention so as to create cavities, the volume of which varies on the deformation of the rhomb, these external and inner cavities to the rotor (or to the rhomb) being able to be realized in different ways.

In a first embodiment, which relates to the external cavities, represented in FIGS. 1 and 2 by a complete cycle of the rhomb 4, an external working cavity 8 (understood to mean external to the rotor 3) is formed by an extrados peripheral cavity 14. Such an extrados peripheral cavity 14 is formed by the extrados face 9 of one of the pistons 6 of the rhomb 4 against the interior wall of the stator 2 and the closure flanges 12, 13 on either side of the machine. FIG. 1 shows the example of the left-hand extrados peripheral cavity 14. In the initial position (FIG. 1*a*), the extrados peripheral cavity in the lower part is initially empty, or of minimal volume. The following FIGS. (1*b* to 1*f*) show the evolution of this cavity (represented in dots) when the rhomb 4 turns in the direction indicated in the figure. The figure does not show the filling devices. FIG. 1*b* shows the start of the intake. FIG. 1*c* shows a state of the intake phase in which the cavity further increases in volume. In FIG. 1*d*, the left-hand extrados peripheral cavity 14 has reached its maximum volume; in a preferred manner, the rhomb 4 then takes the shape of a square. Then (FIG. 1*e*), the volume of the cavity decreases and the fluid is evacuated. The discharging devices are not represented in this figure. In FIG. 1*f*, the left-hand extrados peripheral cavity 14 reaches its minimum volume or even empties completely. It is, at the same time, the end of the discharging and the start of the intake for the following cavity. The analogous cycle for the right-hand extrados peripheral cavity 14 is shown in FIGS. 2*a* to 2*f*. Each right-hand extrados peripheral cavity 14 carries out a cycle per half-turn. By way of example, the capacity of such a cavity represents approximately $1/50^{th}$ of the volume of the machine, that is: a capacity of $4/50^{th}$ of the volume of the machine per turn. So as to be able to exchange a fluid with a circuit exterior to the machine, one can access these extrados peripheral cavities 14 through ducts formed in the pistons 6, or in the pivots 7 or in the stator 2 or else in the lateral closure flanges 12, 13, as will be explained below.

A device can thus be realized which uses one, two, three or four extrados peripheral cavities 14 simultaneously, the phase interval of two adjacent cavities being 90°. These extrados peripheral cavities 14 can have the same function (pump, compressor, motor etc.) or not. By way of example, one cavity can receive a gas under pressure which sets the rotor in motion, whereas the others operate as a compressor or as a pump. If several cavities are operating as a pump, they can operate with the same fluid or with a different fluid. However, with the extrados peripheral cavities 14 using the same interior wall of the stator, there is a risk of contamination between the different fluids of the extrados peripheral cavities 14, because there will always be a permanent film which forms on this interior wall. This risk must be evaluated for each case; it may, for example, be acceptable to transport two alimentary liquids (e.g. water and milk or milk and milk-based paste) in two extrados peripheral cavities, but it would probably not be acceptable to transport an alimentary liquid and a non-alimentary liquid in two extrados peripheral cavities 14, whether adjacent or not. To avoid any risk of cross contamination, two totally separate cavities must be used. This will be explained below.

Thus, by way of example, the machine illustrated in FIGS. 1 and 2 presents a number of left-hand extrados peripheral cavities 14 of 2 or 4 per turn, a number of right-hand extrados peripheral cavities 14 of 2 per turn, and a central cavity, which makes an instantaneous total number of 5 cavities, being able to fulfil three functions.

In a variant illustrated in FIG. 3, an external cavity is an external junction cavity, being defined by the space comprised between two connected pistons 6 of the rotor 3 or which have a pivot connection (or pivotal hinge) 7 in common and the interior wall of the stator 2 (or housing 1), four cavities being thus defined in the space comprised between the rotor 3 and the stator 2. The stator 2 can have a housing 1 of elliptical or circular shape. In the case where the housing is circular, it has a longitudinal axis which is common with that of the rotation of the machine and the cavity defined with the lateral closure flanges is an extrados circular cavity 15. Such an extrados circular cavity 15 carries out a cycle per half-turn of rotation of the rotor, and the four cavities follow each other on a turn. By way of example, the capacity of the extrados circular cavity 15 can represent $1/100^{th}$ of the volume of the machine, that is: a capacity of $2/25^{th}$ of the volume of the machine per turn if the cycles carried out at each half-turn and the four cavities are accumulated on the same function. The guiding of the deformation of the rotor 3 is realized by a central shaft of elliptical section 16. The volume of this cavity varies as a function of the position of the rotor 3, in particular, it increases from a position in which the volume is minimal (FIG. 3*a*) to a fluid intake position (FIG. 3*b*), reaches its maximum volume at the maximum deformation position of the rhomb 4 (FIG. 3*c*), to decrease again and compress the fluid (FIG. 3*d*) before evacuating it completely from the extrados circular cavity 15 (position of the rhomb similar to that of position 3*a*). So as to be able to exchange a fluid with a circuit exterior to the machine, one can access these extrados circular cavities 15 through channels formed in the pistons 6, or in the pivots 7 or in the stator 2 or else in the lateral closure flanges 12, 13.

Advantageously, when the housing 1 is circular, this variant embodiment comprises a structural simplification associated with a significant reduction to the manufacturing cost, in so far as the stator 2 and the housing 1 can be obtained directly from a standard profile of circular section, avoiding the machining operations by removal of material. Thus, by way of example, the machine illustrated in FIG. 3 has a number of extrados circular cavities 15 of 8 per turn, a number of intrados peripheral cavities 17 of 8 per turn, which makes an instantaneous total number of 8 cavities, being able to fulfil four functions. The intrados cavities 17 are defined between the rotor 16 and the intrados faces 11 of the pistons.

In a second embodiment relating to the inner cavities, which can be combined with the first embodiment, a working cavity is formed by a cavity internal to the rotor 3. This cavity uses a profile internal to the rhomb 4, this profile being of the RMDR type, i.e. a profile which follows the laws of deformation of the rhomb, which is, in a first variant illustrated in FIGS. 4*a* to 4*d*, associated with the interior surface, designated the intrados face 11 of the pistons 6. FIG. 4*a* shows an example of four intrados peripheral cavities 17, two of which are left-hand and two are right-hand, as seen with respect to a vertical axis passing through the centre of the rotor 3. One can also use, alternatively or at the same time, the left-hand intrados peripheral cavity or the right-hand one. Thus, as in the case of the extrados peripheral cavities 14, one has up to four intrados peripheral cavities 17 for working simultaneously, which can fulfil different functions but which share a common element, the central shaft, which is liable to lead to a cross contamination. This profile which is at the exterior of the rhomb offers a common surface to all the extrados peripheral cavities. In the same way, the profile which is in the interior of the rhomb offers a common surface to all the intrados peripheral cavities. However, the dynamic tightness between the flanges of the machine and the pistons can permit a cross contamination. As indicated above, there is little risk of cross contamination between the extrados peripheral cavities 14 and the intrados peripheral cavities 17, and if one wishes to use two working fluids which are incompatible with each other, one uses the first of these fluids in an extrados peripheral cavity 14, and the second in an intrados peripheral cavity 17. It is to be noted in FIGS. 4*b* to 4*d* that the left-hand extrados cavities 14 and the left-hand intrados cavities 17 are in phase opposition (the volume of one increases whilst the volume of the other decreases with the rotation of the rhomb 4, and arrives at a maximum value whilst the value of the other is minimal) and the same applies to the right-hand extrados cavities 14 and intrados cavities 17. The capacity of an intrados peripheral cavity 17 is slightly less than that of the extrados peripheral cavity 14, this difference in capacity is essentially linked to the thickness of the pistons. The ratio of the capacity of the intrados cavities over that of the extrados cavities is less than 1. So as to be able to exchange a fluid with a circuit exterior to the machine, one can access these intrados peripheral cavities 17 through ducts formed in the pistons 6, or in the pivots 7 or in the stator 2 or else in the lateral closure flanges 12, 13.

In an extreme case, one thus has eight different working cavities. By way of example, if the rotor is driven by an external motor, both times four cavities can be used as a compressor or as a pump.

Thus, by way of example, the machine illustrated in FIG. 4 has two left-hand extrados peripheral cavities 14, two right-hand extrados peripheral cavities 14, two left-hand intrados peripheral cavities 17 and two right-hand intrados peripheral cavities 17, which makes an instantaneous total number of 8 cavities, being able to fulfil four functions.

FIGS. 3*a* to 3*d* show in addition left-hand and right-hand intrados peripheral cavities 17, which can be combined with extrados circular cavities 15, as has been explained above, so as to be obtain up to eight different working cavities.

In a second variant of this embodiment illustrated in FIGS. 5*a* to 5*d*, the inner cavities are partially circular intrados cavities 18, one cavity being formed between the intrados faces 11 of two connected pistons 6 (or which have having a pivot connection 7 in common), and a circular cylinder 19 internal to the rhomb 4, the longitudinal axis of which is common to the central shaft of the machine. Such an intrados circular cavity 18 carries out a cycle per half-turn and the four cavities follow each other on a turn. By way of example, the capacity of such an intrados circular cavity 18 represents approximately $1/100^{th}$ of the volume of the machine, that is: a capacity of $2/25^{th}$ of the volume of the machine per turn if one accumulates the four cavities and the two cycles per turn. It is to be noted that the deformation of the rhomb 4 is in this case guided by the internal profile of the housing 1 of the stator 2. So as to be able to exchange a fluid with a circuit exterior to the machine, one can access these intrados circular cavities 18 through ducts formed in the pistons 6, or in the pivots 7 or in the stator 2 or else in the lateral closure flanges 12, 13.

Thus, by way of example, the machine illustrated in FIG. 5 has two left-hand extrados peripheral cavities 14, two right-hand extrados peripheral cavities 14, and four intrados circular cavities 18, which makes an instantaneous total number of 8 cavities, being able to fulfil four functions.

Figure 6A:
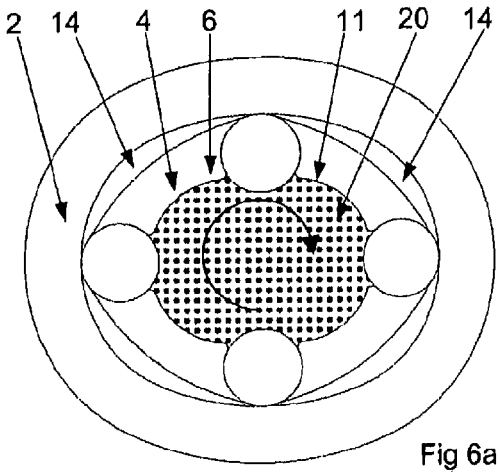
FIGS. 6*a* to 6*d* illustrate inner cavities according to a third variant embodiment.
Figure 6B:
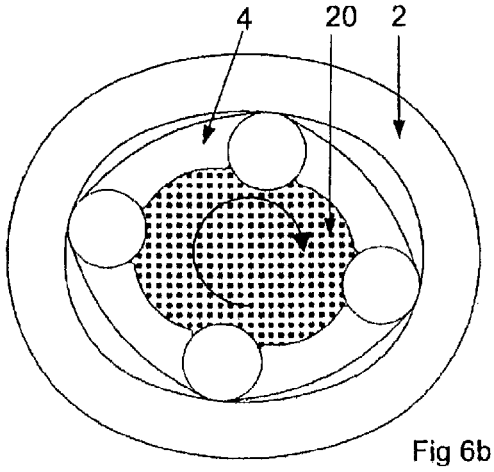
Figure 6C:
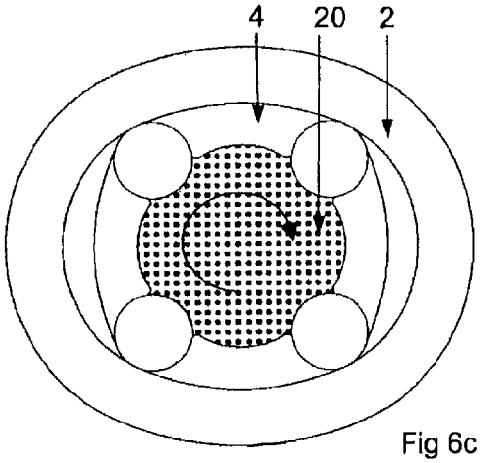
Figure 6D:
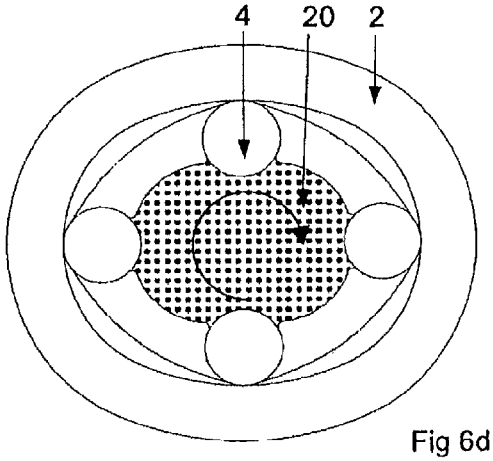

In a third variant embodiment, illustrated in FIGS. 6*a* to 6*d*, one uses a working cavity formed by a central inner cavity 20 of the rotor 3. This central inner cavity 20 is comprised between the interior surface designated the intrados face 11 of all the pistons 6 and the lateral closure flanges (not illustrated). In the initial position (FIG. 6*a*), the central inner cavity 20 is initially of minimal volume. The following FIGS. 6*b* to 6*d*) show the evolution of this cavity (represented in dots) when the rhomb 4 turns in the direction indicated in the figure. The figure does not show the filling devices. FIG. 6*b* shows the start of the intake, the cavity continues to increase in volume during the entire intake phase. In FIG. 6*c*, the cavity has reached its maximum volume; in a preferred manner, the rhomb 4 then takes the shape of a square. Then (FIG. 6*d*), the volume of the cavity decreases and the fluid is evacuated, the cavity then reaches its minimal volume, which corresponds to the end of the discharging and the start of the intake for the following cavity. Such a central inner cavity 20 carries out 4 cycles per turn, hence a cycle two times shorter than that of an extrados peripheral cavity 14. By way of example, the capacity of this zone represents approximately $1/40^{th}$ of the volume of the machine, that is: $1/10^{th}$ of the volume of the machine per turn. So as to be able to exchange a fluid with a circuit exterior to the machine, one can access this central inner cavity 20 by a rotation shaft (not shown), by the pivots 7 or by the lateral closure flanges 12, 13.

A machine which would use in combination the extrados peripheral cavities 14 and this central inner cavity 20 would then be able to have five different working cavities, each being able to operate independently. Thus, by way of example, the machine illustrated in FIGS. 6*a* to *d* has a number of left-hand extrados peripheral cavities 14 of 2 or 4 per turn, a number of right-hand extrados peripheral cavities 14 of 2 per turn, and a central cavity, which makes an instantaneous total number of 5 cavities, being able to fulfil three functions.

Figure 7A:
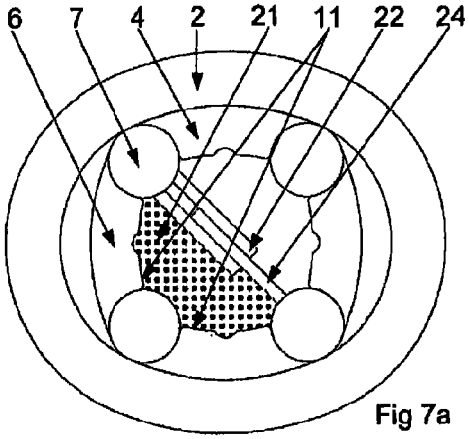
FIGS. 7*a* to 7*e* illustrate inner cavities according to a fourth variant embodiment.
Figure 7D:
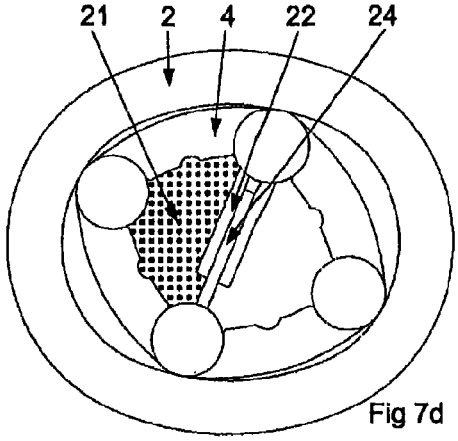
Figure 7B:
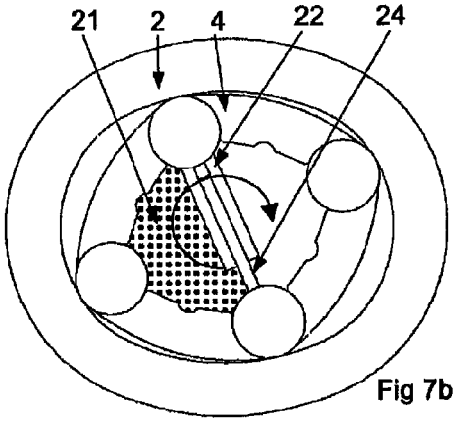
Figure 7E:
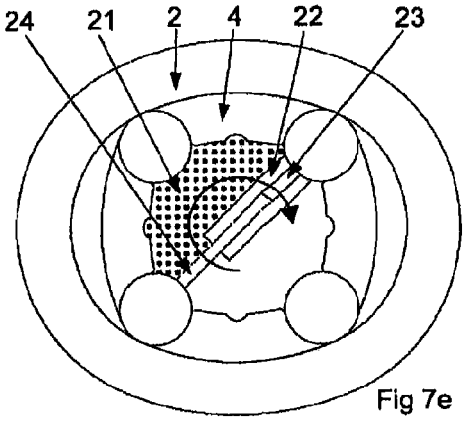
Figure 7C:
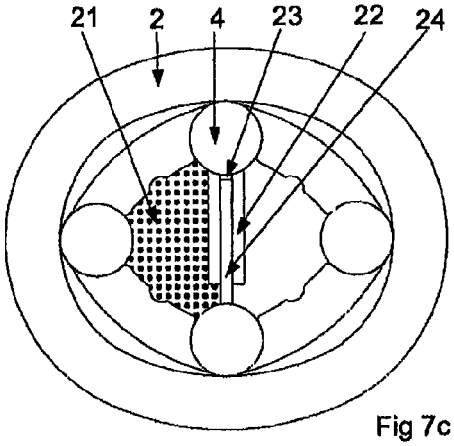

In a fourth variant embodiment, a working cavity is realized by a central cavity of the rotor or rhomb 4 divided by one diagonal 21. This cavity is comprised between the interior surface designated the intrados face 11 of two connected pistons 6 and the diagonal connecting them. In the initial position (FIG. 7*a*), the central cavity of the rotor divided by one diagonal 21 is initially of minimal volume. The following figures (b to d) show the evolution of this cavity (represented hatched) when the rhomb 4 turns in the direction indicated in the figure. The figure does not show the filling devices. FIG. 7*b* shows the start of the intake, the cavity continues to increase in volume during the entire intake phase. In FIG. 7*c*, the cavity has reached its maximum volume; in a preferred manner, the rhomb 4 then takes the shape of a square. Then (FIG. 7*d*), the volume of the cavity decreases and the fluid begins to be evacuated. In FIG. 7*e*, the cavity reaches its minimal volume, which corresponds to the end of the discharging and the start of the intake for the following cavity. Such a central cavity of the rotor divided by one diagonal 21 carries out four cycles per turn and two cavities follow each other on a turn, therefore a cycle two times shorter than that of an extrados peripheral cavity. By way of example, the capacity of this zone represents approximately $1/80^{th}$ of the volume of the machine, that is: $1/20^{th}$ of the volume of the machine per turn. So as to be able to exchange a fluid with a circuit exterior to the machine, one can access these cavities by a rotation shaft (not shown), by the pivots 7, or by the lateral closure flanges 12, 13.

It is to be noted that a diagonal divides the central cavity in two parts, which allows two devices to be put in place having the same capacity within the machine. These devices can be independent or connected mechanically or being able to exchange a fluid between each other. A machine which would use in combination the external peripheral cavities 14 and two such central cavities divided by one diagonal 21 would then be able to have six different working cavities, each being able to operate independently.

Figure 7F:
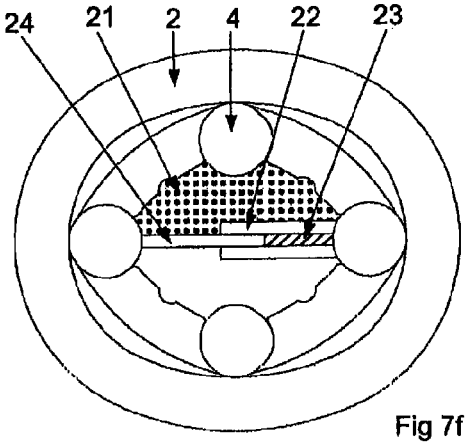
FIG. 7*f* illustrates an inner cavity according to a fifth variant embodiment.

The changes in length of the diagonal of the rotor can be compensated by a slide 22, by a membrane or another device allowing a variation in length of the diagonal wall to be compensated and at the same time allowing the tightness of the cavity to be ensured. In a fifth variant, one can use as a working cavity the cylindrical cavity of slide 23 (represented hatched in FIG. 7*f*), which is therefore situated in the interior of the slide cylinder 24 of the slide 22 for closure of the central cavity divided by one diagonal 21. The volume of this cylindrical cavity of slide 23 can vary between a minimal volume, with the slide then having the length of the small diagonal (as in the position illustrated in FIG. 7*c*) and a maximum volume illustrated in FIG. 7*f*, when the slide reaches the length of the large diagonal.

A machine which would use in combination the extrados peripheral cavities 14 and two such central cavities divided by one diagonal 21 and where each diagonal would have a variable-volume cylindrical cavity of slide 23, could then have seven different working cavities, each being able to operate independently. Thus, by way of example, the machine illustrated in FIG. 7 has two left-hand extrados peripheral cavities 14, two right-hand extrados peripheral cavities 14, two central cavities divided by one diagonal 21 and a cylindrical cavity of slide 23, which makes an instantaneous total number of 7 cavities, being able to fulfil five functions.

Figure 8A:
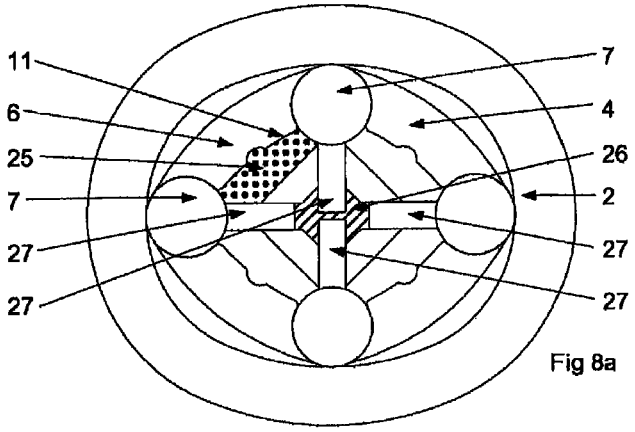
FIGS. 8*a* to 8*e* illustrate inner cavities according to a sixth and a seventh variant embodiment.
Figure 8B:
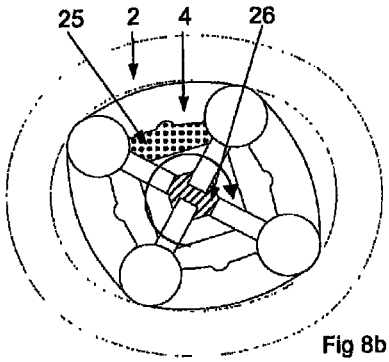
Figure 8D:
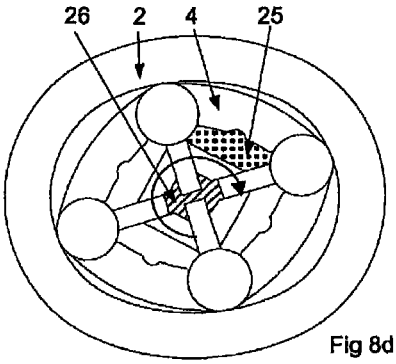
Figure 8C:
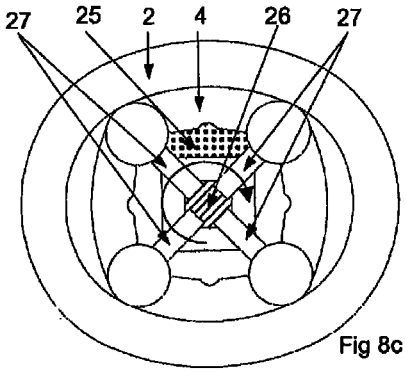
Figure 8E:
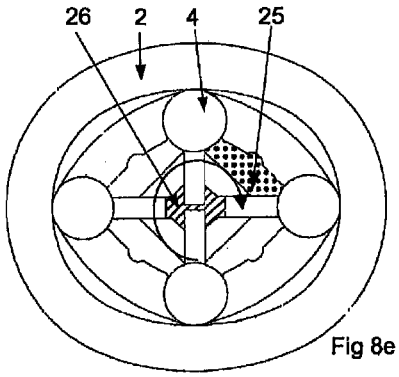

In a sixth variant embodiment which is better visible in FIGS. 8*a* to 8*e*, an inner working cavity is realized by a central cavity of the rotor divided by the two diagonals 25 of the rhomb 4. This cavity is comprised between the interior surface designated the intrados face 11 of a piston 6 and the two diagonals connecting its pivotal hinges 7. In the initial position (FIG. 8*a*), the cavity is initially of minimal volume. The following FIGS. 8*b* to 8*e*) show the evolution of this cavity (represented in dots) when the rhomb 4 turns in the direction indicated in the figures. The figures do not show the filling devices. FIG. 8*b* shows the start of the intake, the cavity continues to increase in volume during the entire intake phase. In FIG. 8*c*, the cavity has reached its maximum volume; in a preferred manner, the rhomb 4 then takes the shape of a square. Then (FIG. 8*d*), the volume of the cavity decreases and the fluid begins to be evacuated. In FIG. 8*e*, the cavity reaches its minimal volume, which corresponds to the end of the discharging and the start of the intake for the following cavity. Such a central cavity of the rotor divided by two diagonals 25 carries out four cycles per turn and four cavities follow each other on a turn, therefore a cycle two times shorter than that of an extrados peripheral cavity. By way of example, the capacity of this cavity alone and on a single cycle represents approximately $1/160^{th}$ of the volume of the machine, that is: a capacity of $1/10^{th}$ of the volume of the machine per turn and for the four cavities. So as to be able to exchange a fluid with a circuit exterior to the machine, one can access these cavities by a rotation shaft (not shown), by the pivots 7 or by the lateral closure flanges 12, 13.

It is to be noted that the diagonals divide the central cavity into four parts, which allows four devices of the same capacity to be put in place within the machine. These devices can be independent (operate in an independent manner with respect to each other) or can be connected mechanically or being able to exchange a fluid with each other. A machine which would use in combination the extrados peripheral cavities 14 and four such central cavities divided by two diagonals 25 could then have eight different working cavities, each being able to operate independently. The changes in length of the diagonal of the rotor can be compensated by a slide, by a membrane or other device allowing a variation in length of the diagonal wall to be compensated and at the same time allowing the tightness of the cavity to be ensured.

In a seventh variant, a central cylindrical cavity 26 can be realized in the centre of the diagonals of the rhomb 4, the cavity being formed by four sliding pistons 27 (FIG. 8*c*), being actuated two by two on the same diagonal and sliding in opposite directions, to vary the volume of a central cylindrical cavity 26. This central cylindrical cavity 26 and its variations in volume on the rotation of the rhomb are better visible in FIGS. 8*a* to 8*e*. In the initial position (FIG.

8*a*), the cavity is initially of minimal volume. The following FIGS. 8*b* to 8*e*) show the evolution of this cavity (represented hatched) when the rhomb turns in the direction indicated in the figures. The figures do not show the filling devices. FIG. 8*b* shows the start of the intake, the cavity continues to increase in volume during the entire intake phase. In FIG. 8*c*, the cavity has reached its maximum volume; in a preferred manner, the rhomb then takes the shape of a square. Then (FIG. 8*d*), the volume of the cavity decreases and the fluid starts to be evacuated. In FIG. 8*e*, the cavity reaches its minimal volume, which corresponds to the end of the discharging and the start of the intake. So as to be able to exchange a fluid with a circuit exterior to the machine, one can access this central cylindrical cavity 26 by a rotation shaft (not shown), by the pivots 7 and the sliding pistons 27, or by the lateral closure flanges 12, 13.

A machine which would use in combination the extrados peripheral cavities 14, four central cavities divided by two diagonals 25 and a variable-volume central cylindrical cavity 26 could then have nine different working cavities, each being able to operate independently. Thus, by way of example, the machine illustrated in FIG. 8 has two left-hand extrados peripheral cavities 14, two right-hand extrados peripheral cavities 14, four central cavities divided by the two diagonals 25 and a central cavity 26, which makes an instantaneous total number of 9 cavities, being able to fulfil seven functions.

Figure 9A:
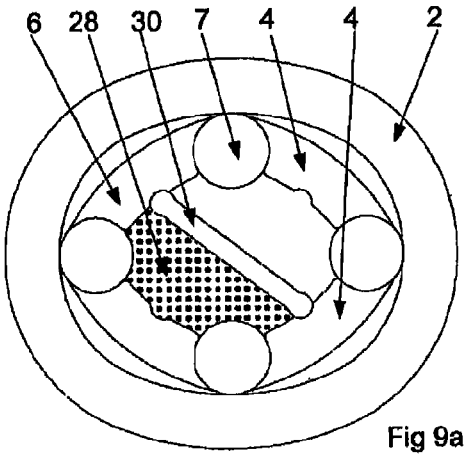
FIGS. 9*a* to 9*c* illustrate inner cavities according to an eighth variant embodiment.
Figure 9B:
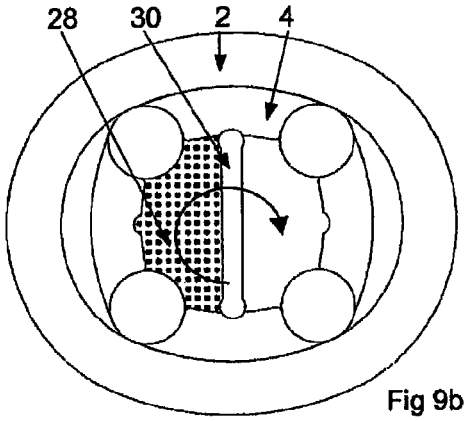
Figure 9C:
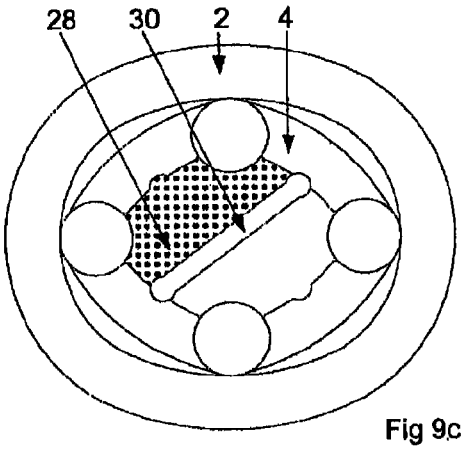

In an eighth variant embodiment, which is better visible in FIGS. 9*a* to 9*c*, a working cavity is realized by a central cavity of the rotor divided by one median 28 of the rhomb 4. This cavity is comprised between the interior surface designated the intrados face 11 of a piston 6 and the median 30 connecting the centres of the two opposite pistons 6. In the initial position (FIG. 9*a*), the cavity is initially of minimal volume. The following FIGS. 9*b* to 9*c*) show the evolution of this cavity (filled by dots) when the rhomb turns in the direction indicated in the figures. The figures do not show the filling devices. FIG. 9*b* shows the position in which the cavity has reached its maximum volume; in a preferred manner, the rhomb then takes the shape of a square. Then, the volume of the cavity decreases and the fluid starts to be evacuated. In FIG. 9*c*, the cavity reaches its minimal volume, which corresponds to the end of the discharging and the start of the intake for the following cavity. Such a central cavity of the rotor divided by one median 28 carries out four cycles per turn and two cavities follow each other on one turn, therefore a cycle two times shorter than that of an extrados peripheral cavity. By way of example, the capacity of this zone represents approximately $1/80^{th}$ of the volume of the machine, that is: a capacity of $1/10^{th}$ of the volume of the machine per turn. So as to be able to exchange a fluid with a circuit exterior to the machine, one can access these cavities by a rotation shaft (not shown), by the pivots 7 or by the lateral closure flanges 12, 13.

This embodiment presents the advantage of a structural simplification, with the median not changing in length on the rotation and, as a result, one can use simplified tightnesses. Thus, by way of example, the machine illustrated in FIG. 9 has two left-hand extrados peripheral cavities 14, two right-hand extrados peripheral cavities 14, two central cavities divided by one median 28, which makes an instantaneous total number of 6 cavities, being able to fulfil four functions.

Figure 10A:
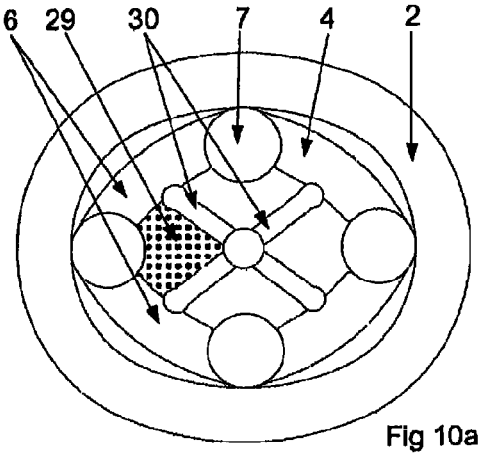
FIGS. 10*a* to 10*c* illustrate inner cavities realized according to a ninth variant of the invention.
Figure 10B:
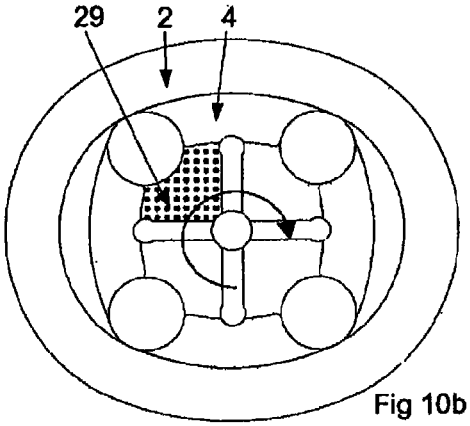
Figure 10C:
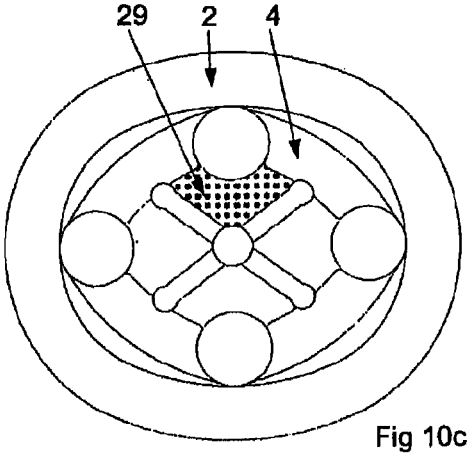

In a ninth variant embodiment, which is better visible in FIGS. 10*a* to 10*c*, a working cavity is realized by a central cavity of the rotor divided by two medians 29 of the rhomb 4. This cavity is comprised between the interior surface designated the intrados 11 of two connected pistons 6, their pivotal hinge 7 and the two adjacent segments each corresponding to half of each of the two medians 30 connecting the median points of connected two opposite pistons 6. In the initial position (FIG. 10*a*), the cavity is initially of minimal volume. The following FIGS. 10*b* to 10*c*) show the evolution of this cavity (represented in dots) when the rhomb turns in the direction indicated in the figures. The figures do not show the filling devices. FIG. 10*c* shows the position in which the cavity has reached its maximum volume; in a preferred manner, the rhomb then takes the shape of a square. Then, the volume of the cavity decreases and the fluid starts to be evacuated. In FIG. 10*c*, the cavity reaches its minimal volume, which corresponds to the end of the discharging and the start of the intake. Such a cavity carries out four cycles per turn and four cavities follow each other on a turn, therefore a cycle two times shorter than that of an extrados peripheral cavity. By way of example, the capacity of this central cavity of the rotor divided by two medians 29 represents approximately $1/160^{th}$ of the volume of the machine, that is: a capacity of $1/10^{th}$ of the volume of the machine per turn. So as to be able to exchange a fluid with a circuit exterior to the machine, one can access these cavities by a rotation shaft (not shown), by the pivots 7 or by the lateral closure flanges 12, 13.

In a manner similar to the previous embodiment, this embodiment presents the advantage of a structural simplification, owing to the fact that the medians of the rhomb do not change in length on the rotation of the latter.

Thus, by way of example, the machine illustrated in FIG. 10 has two left-hand extrados peripheral cavities 14, two right-hand extrados peripheral cavities 14, four central cavities divided by the two medians 29, which makes an instantaneous total number of 8 cavities, being able to fulfil six functions.

Figure 11A:
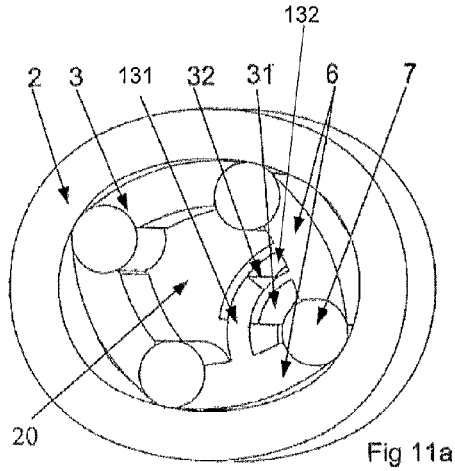
FIGS. 11*a* to 11*c* illustrate inner cavities realized according to a tenth variant of the invention.
Figure 11B:
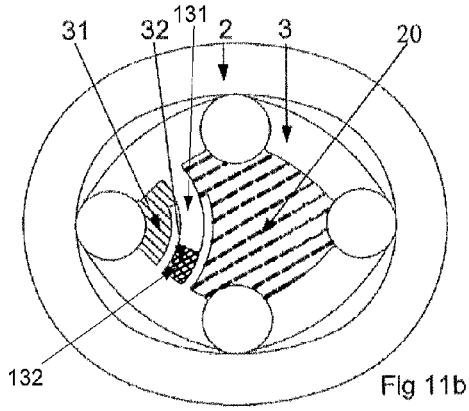
Figure 11C:
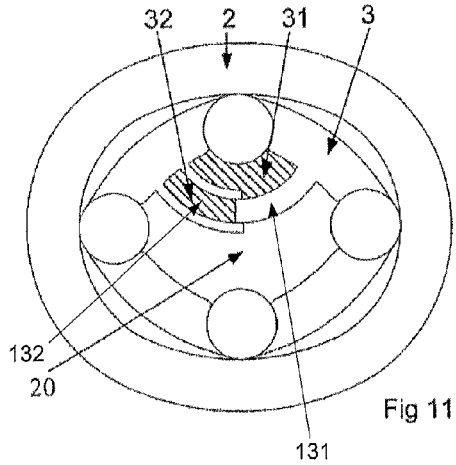

In a tenth variant embodiment, a working cavity is realized by an off-center tonic cavity situated in the interior of the rotor 3, two off-center tonic cavities 31, 32 being illustrated in FIGS. 11*a* to 11*c*. One of these cavities, designated the off-center external tonic cavity 31, is formed by two tonic devices 131, 132 of complementary section (for example of the piston type 131 sliding in a cylinder 132), being able to move in a circular arc following the deformation of the rhomb, each resting on a piston 6 and closing a volume delimited by a pivotal hinge 7 of the rhomb 4; the intrados face 11 of two connected pistons 6, connected by the pivotal hinge 7, and the external surface of the tonic devices 33. A second inner tonic cavity 32 is formed in the interior of one of the toric devices 131, 132 (for example of the cylinder 132) on the displacement, relative to the first, of a second cylindrical device (the piston 131). In the initial position (FIG. 11*b*), the cavity is of minimal volume. In FIG. 11*c*, the cavity has reached its maximum volume, then the volume of the cavity decreases and the fluid starts to be evacuated. It is to be noted that the generally very small capacity of this solution and the simple geometries allow very high pressures to be obtained in the fluid circuit at the outlet of the machine. So as to be able to exchange a fluid with a circuit exterior to the machine, one can access these cavities by a rotation shaft (not shown), by the pivots 7 or by the lateral closure flanges 12, 13.

Several toric cavities can thus be realized in the interior of the rotor, for example by arranging them around each pivotal hinge of the rhomb. A machine which would use in combination four external cavities, four off-center external toric cavities, four inner toric cavities and a central cavity of variable volume could then have thirteen different working cavities, each being able to operate independently. It is to be noted that the central cavity can itself be sub-divided into several cavities by a membrane wall, as described in the example embodiment illustrated by FIG. 14, which increases the total number of variable-volume cavities.

Thus, by way of example, the machine illustrated in FIG. 11 has two left-hand extrados peripheral cavities 14, two right-hand extrados peripheral cavities 14, one to four off-center external toric cavities 31, one to four off-center inner toric cavities 32 and one central cavity 20, which makes an instantaneous total number of 13 cavities, being able to fulfil eleven functions.

Figure 12A:
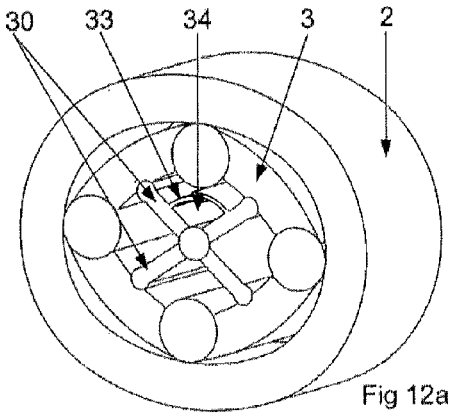
FIGS. 12*a* to 12*c* illustrate inner cavities realized according to an eleventh variant of the invention.
Figure 12B:
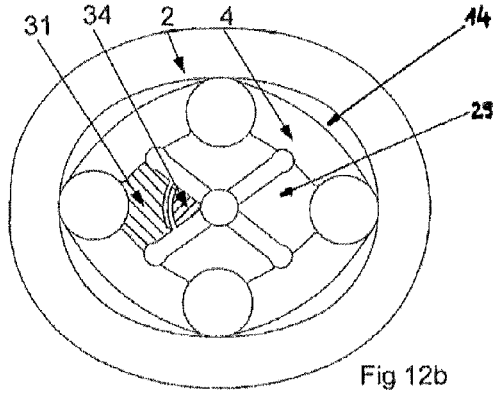
Figure 12C:
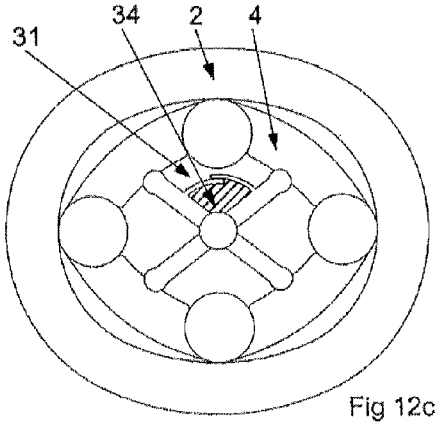

In an eleventh variant of this embodiment, better visible in FIGS. 12*a* to 12*c*, variable-volume toric cavities can be realized in the centre of the rotor with deformable rhomb. Such a cavity is realized around the central axis passing through the intersection point of the medians 30 and is delimited by two toric devices sliding in a circular arc, each resting on a median arm 30. In the initial position, represented in FIG. 12*b*, the central toric cavity 34 is of minimal volume. The volume of the cavity increases with the rotation of the rotor and reaches its maximum volume (FIG. 12*c*), then the volume of the cavity decreases and the fluid starts to be evacuated. As in the example of FIGS. 11*a* to 11*c*, toric cavities of very small volume can also be formed in the interior of the toric devices. So as to be able to exchange a fluid with a circuit exterior to the machine, one can access these cavities by a rotation shaft (not shown), by the pivots 7 or by the lateral closure flanges 12, 13. These cavities which are internal to the rotor can be used as a complement to the external cavities of the machine, as described in the first embodiment, and one thus obtains a machine being able to realize several functions (motor, for transformation of energy, for pumping, for compression) simultaneously (in parallel) or successively (in series).

Thus, by way of example, the machine illustrated in FIG. 12 presents two left left-hand extrados peripheral cavities 14, two right-hand extrados peripheral cavities 14, one, to four central toric cavities 34, one to four off-center external toric cavities 31, which makes an instantaneous total number of 12 cavities, being able to fulfil ten functions.

An example application of a machine, the structure of which is realized in accordance with FIGS. 12*a* to 12*c* will be described below. This is a food dosing pump driven by compressed air.

This functionality is very useful when one wishes to avoid the problems of pollution of the electrical driving members by the alimentary pastes and to simplify the management of a production automaton which is very often pneumatic.

Compressed air fills the cavities 14. The pressure of the air drives the rotor in rotation. The air leaves the cavities 14 of the machine again at a lower pressure than that on entry. The cavities 14 turbine the air.

Alimentary paste is dosed in the cavities 29 before being decanted in the central toric cavities 34 (a single cavity 34 is shown in the figures for reasons of simplification, but one can, however, envisage the use of four central toric cavities 34 with the illustrated machine).

The alimentary paste which is thus dosed by the first cavities 29 is taken into the cavities 34. The rotation of the rotor causes the reduction to the volume of the cavity 34, which allows the mixing and the injection of this paste in the discharging circuit of the machine.

The design of the machine is facilitated by adapting the capacities of the cavities to the needs of the automaton of the installation. The cavities can have a dead volume of approximately zero to avoid the dead zones which are detrimental to food safety. The construction permits a very easy cleaning of the machine.

The turbining and the compression are simultaneous (operation in parallel), whereas the dosage and the injection of the alimentary paste are carried out successively (for an operation in series).

In another embodiment, not illustrated in the drawings, the machine can comprise external cavities, as described in the first embodiment, and an inner helicoidal cavity. By way of indication, the inner helicoidal cavity can be realized between a solid screw moving in a suitable blind tapping. The tapping can be entrained in rotation by one of the median arms of the rotor, the screw being fixed or entrained in rotation by the other median arm. The difference in speeds between the tapping and the screw causes a variation in volume of the inner helicoidal cavity. The capacity of the inner helicoidal cavity is very small, the pressure generated then being able to reach very high values.

Figure 13A:
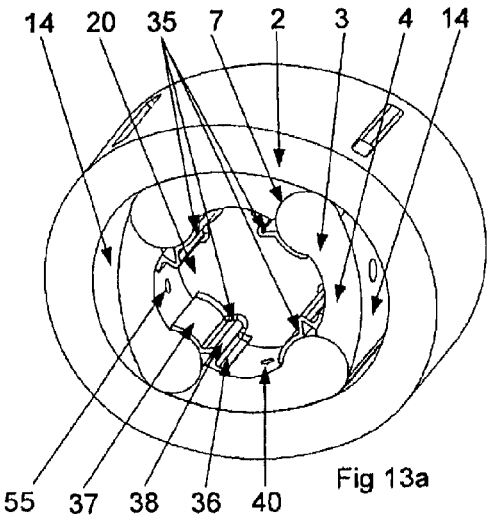
FIG. 13*a* illustrates a perspective view of an example of embodiment of the machine of the invention, the front flange having been removed, in one of the positions of the rhomb.
Figure 13B:
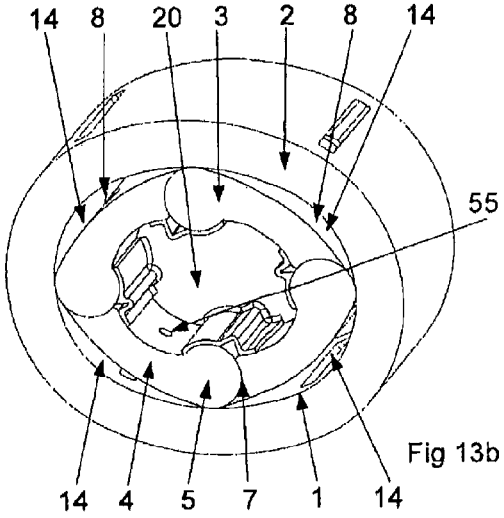
FIG. 13*b* is a similar view to the preceding one, with the rhomb moved in another position.

FIGS. 13*a* and 13*b* illustrate an example embodiment of a machine according to the invention comprising four extrados peripheral cavities 14 and one central inner cavity 20. The central inner cavity 20 is delimited by the space comprised between the internal surfaces or intrados faces 11 of the four pistons 6 and four flexible membranes 35 fixed to the pistons 6 at the level of their pivotal hinges 7. The flexible membrane 35 has two end tabs 36, 37 connected by a bellows 38. The tabs 36, 37 serve as a fixing means to the pistons 6, one of the end tabs 36 resting on the internal surface of a piston 6, the bellows 38 coming to cover the pivotal hinge 7 and the other end tab 37 resting on the connected piston 6 or adjacent to the preceding one. On the rotation and hence the deformation of the rhomb 4, the bellows 38 deforms and ensures the tightness in the inner central cavity 20 and also the tightness of the extrados peripheral cavities 14 through the pivotal hinge 7. Inlet/outlet orifices in the external cavities permit the access of a fluid in the external cavities of the machine, this fluid being able to communicate with the inner cavity by orifices formed through the pistons 6 of the rotor 3.

Figure 14:
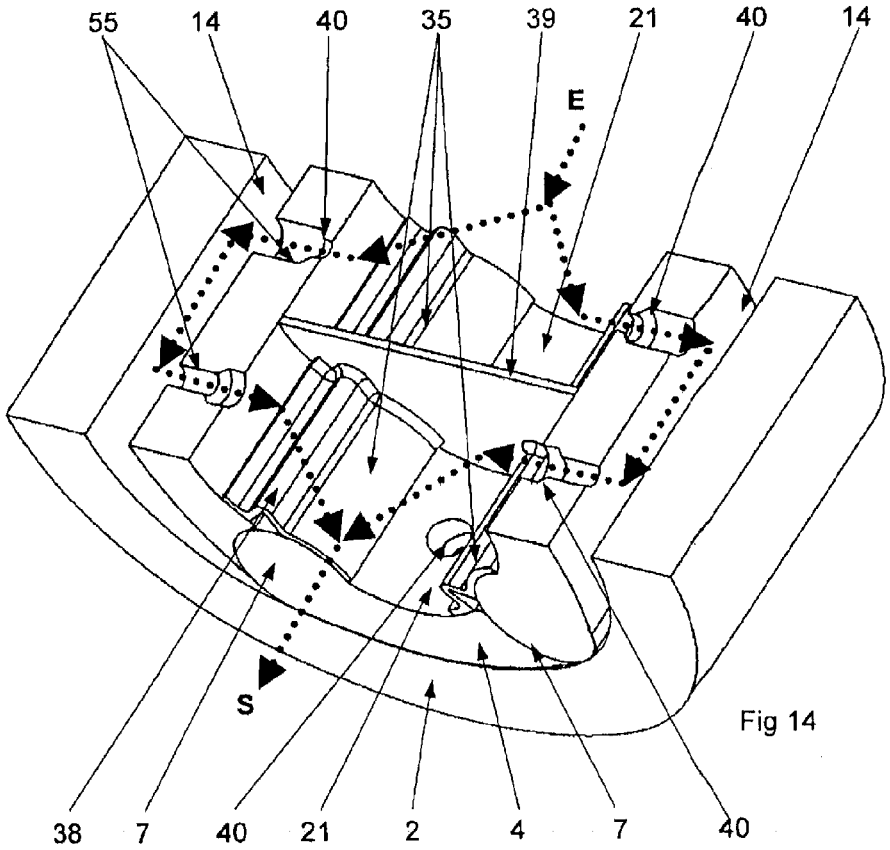
FIG. 14 illustrates another example of embodiment of the machine of the invention, the latter being represented diagrammatically, by a transverse section view.

FIG. 14 illustrates another example embodiment of a machine according to the invention, in which the pivotal hinges 7 of the rhomb 4 are protected by flexible membranes 35 of the type previously described, but in which the central cavity 20 comprises a flexible membrane wall 39 arranged according to one of the diagonals of the rhomb 4, so as to connect two opposite pivotal hinges 7. This membrane wall 39 then divides the inner central cavity into two central cavities of the rotor divided by one diagonal 21, having the same volume. The arrows of FIG. 14 illustrate the circuit of a processing fluid in the interior of the machine from its entry (arrow E) to its exit (arrow S). In operation, the machine illustrated in FIG. 14 receives at the inlet a fluid which is to be treated according to the axial direction (arrow E), this fluid undergoing a first thermodynamic operation (in particular compression or expansion) in the interior of the first central cavity divided by one diagonal 21 of the machine. The fluid is then sent into the extrados peripheral cavities 14 via check valve orifices 40 shutting off the ducts formed in the pistons 6. The fluid undergoes another operation in the extrados peripheral cavities 14 and is then discharged in the second central cavity. The fluid undergoes a third operation in the second central cavity divided by one diagonal 21, then it is discharged to the exterior of the machine according to an axial outlet direction (arrow S).

Thus, by way of example, the machine illustrated in FIG. 14 presents two left-hand extrados peripheral cavities 14, two right-hand extrados peripheral cavities 14, two central cavities divided by one diagonal 21, which makes an instantaneous total number of 6 cavities, being able to fulfil three functions.

According to a preferred embodiment of the invention, the machine is designed so as to generate a dynamic pressure which is added to the static pressure due to the deformation of the receiving cavity of the working fluid which is sets in motion. This dynamic pressure is obtained by providing with blades the stator 2, the rotor 3, the arms of medians 30 or the arms of the diagonals 41, 42.

Figure 15A:
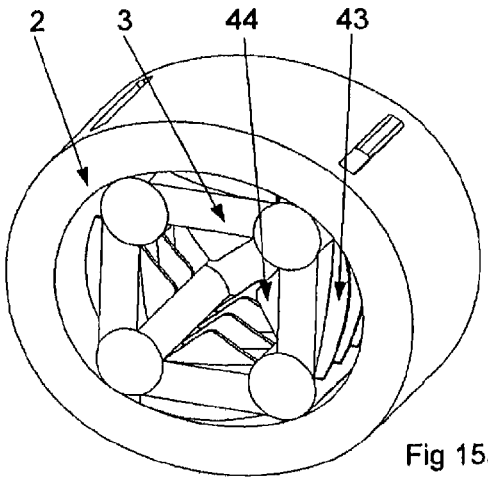
FIG. 15*a* illustrates a perspective view of a machine of the invention comprising a rotor realized according to a variant of embodiment and FIG. 15*b* illustrates the rotor of FIG. 15*a*.
Figure 15B:
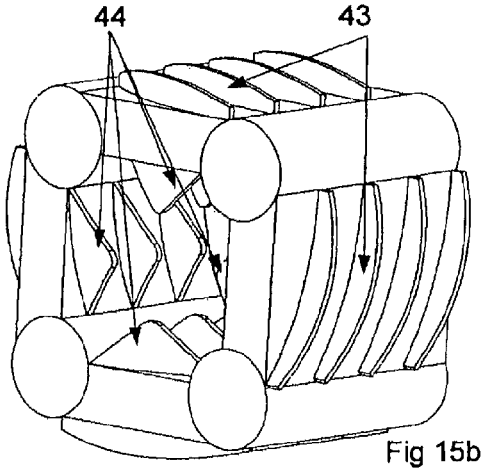

Thus, FIGS. 15*a* and 15*b* illustrate an example embodiment in which the pistons 6 are provided with blades 44 on the intrados and blades 43 on the extrados, these blades being inclined and uniformly distributed over the intrados and over the extrados of the pistons. A rotor 3 provided with blades 43, 44 turning in the interior of a stator 2 having a smooth internal surface allows the machine to have an operation as a centrifugal pump or a turbine if the housing is in fact the stator. If the housing turns whereas the rhomb is fixed in rotation, the blades of the pistons 6 will behave as a rectifier.

Figure 16A:
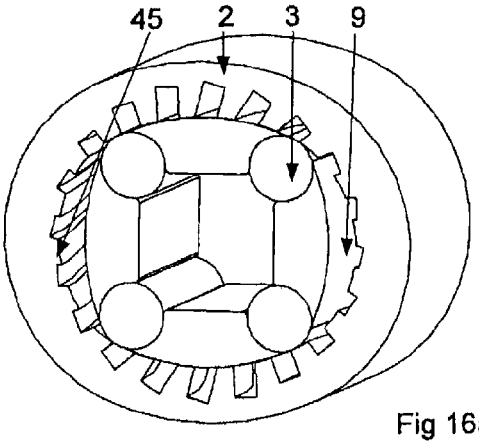
FIG. 16*a* illustrates a perspective view of a machine of the invention comprising a stator realized according to a variant of embodiment and FIG. 16*b* illustrates the stator of FIG. 16*a*.
Figure 16B:
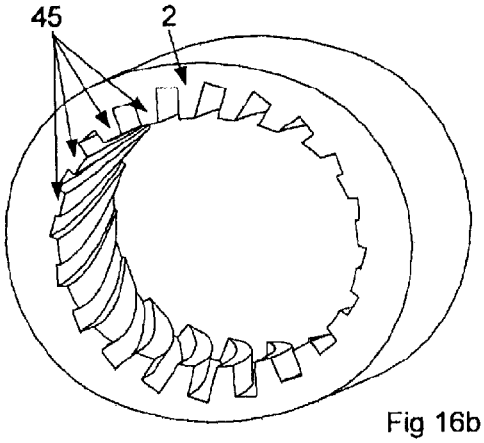

FIGS. 16*a* and 16*b* illustrate another example embodiment in which the internal surface of the housing 1 of the stator 2 is provided with blades 45 which are inclined and uniformly distributed over the internal surface of the stator. In another example (not illustrated in the figures), the spacing of the blades can be variable. A rotor 3 having a smooth extrados face 9 turning in the interior of a stator 2 provided with blades 45 then allows the machine to operate as a hydraulic or pneumatic rectifier if the housing is in fact the stator. If the housing turns whereas the rhomb is fixed in rotation, the blades of the housing 1 will behave as a centrifugal turbine or pump.

Figure 17A:
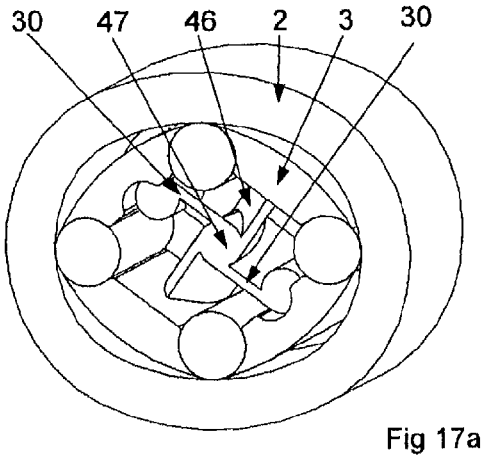
FIGS. 17*a* and 17*b* illustrate, in two different positions of the rhomb, a machine of the invention comprising a rotor realized according to another variant of the invention.
Figure 17B:
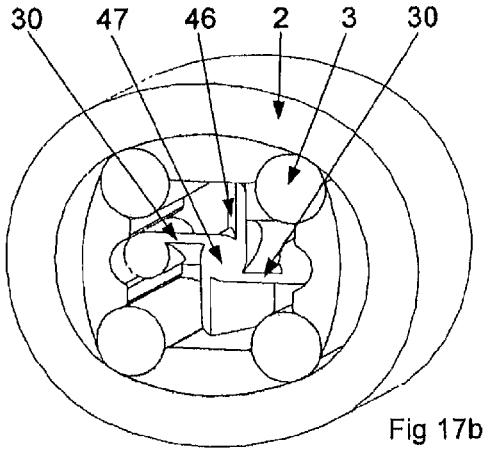

FIGS. 17*a* and 17*b* illustrate another example embodiment in which each median arm 30 is provided with blades 46 having inclined walls thus forming a propeller 47 having four blades (or more) in the interior of the rotor 3. This solution is particularly advantageous, because it is very simple, the length of the median arms 30 being constant. In addition, the flow of the fluid in the interior of the rotor has proved to be less turbulent than that on a passage in the interior of a rotor provided with blades on the intrados of the pistons.

Figure 18A:
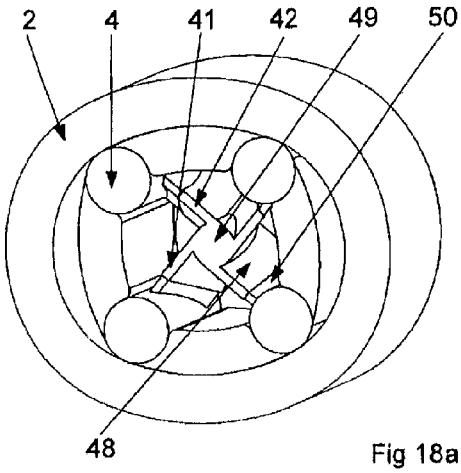
FIGS. 18*a* and 18*b* illustrate, in two different positions of the rhomb, a machine of the invention comprising a rotor realized according to another further variant of the invention.
Figure 18B:
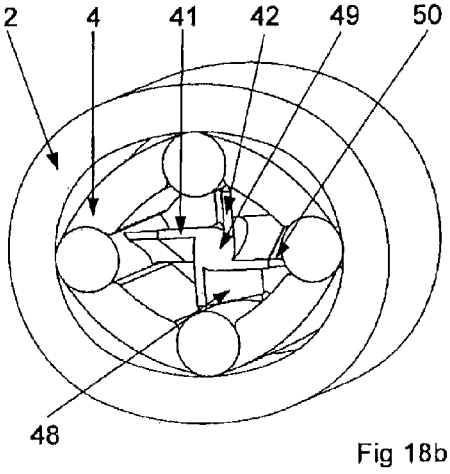

FIGS. 18*a* and 18*b* illustrate another further example embodiment in which the arms of the diagonals 41, 42 are provided with blades 48 having inclined walls thus forming a propeller 49 with four blades (or more) in the interior of the rotor or of the rhomb 4. The advantage of such an arrangement of blades is that, with the rotation speed of the diagonal arms being constant, the flow of the fluid is less turbulent than on a passage in the interior of a rotor provided with blades on the intrados of the pistons. The blades 48 of the propeller 49 are telescopic, so as to be able to adapt to the variation in length of the arms of the diagonals 41, 42 on the rotation of the rhomb 4. Each propeller blade 48 comprises, in the direction of a diagonal arm 41, 42 a fixed part 50 resting on the periphery of a pivotal hinge 7 which is caused to slide, on the rotation of the rhomb 4, in the interior of a blade part 48 belonging to a central hub of the propeller 49.

In a variant, not illustrated in the figures, both the stator 2 and the rotor 3 can be provided with blades of the type 43, 44 for the pistons 6 of the rotor 3 or 45 for the stator 2. One can also envisage using a stator with blades which is suitable to receive a rotor provided with blades 46 on the arms of its medians or else a rotor provided with blades 48 on the arms of its diagonals.

Advantageously, the extrados blades 43, the intrados blades 44, the stator blades 45, the median arm blades 46, the propellers 47, 49, the diagonal arm blade 48 and the fixed part of blade 50 promote the heat exchanges.

Due to its construction with at least three variable-volume cavities, the rotary machine with a deformable rhomb of the invention allows several functions to be ensured which are selected from those of: motor, pump, compressor or turbine, or a combination of these, an exchange of fluid being established with one or several circuits external to the machine, and also between the various variable-volume cavities thereof. The exchange zones (or means for transfer or exchange) of fluid within the machine are illustrated in FIGS. 19 to 23. These exchange zones are inlet or outlet orifices communicating, on the one hand, with fluid circuits external to the machine and, on the other hand, with ducts formed within its elements opening out in external or inner cavities of the machine, as will be explained below.

Figure 19:
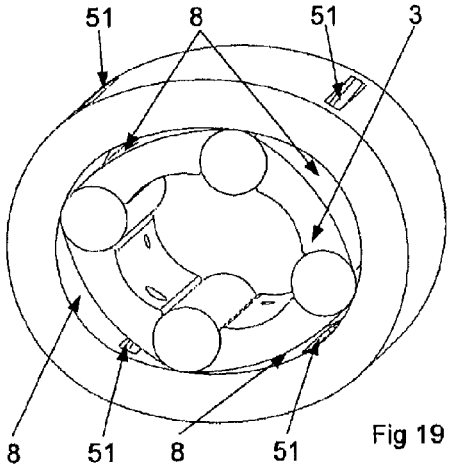
FIG. 19 illustrates a simplified perspective view of the machine.

FIG. 19 illustrates four radial fluid inlet or outlet orifices 51 in the external cavities of the machine; these orifices are formed on the external surface of the stator 2 and pass radially through its thickness to open out in the external cavities 8 of the machine.

Figure 20A:
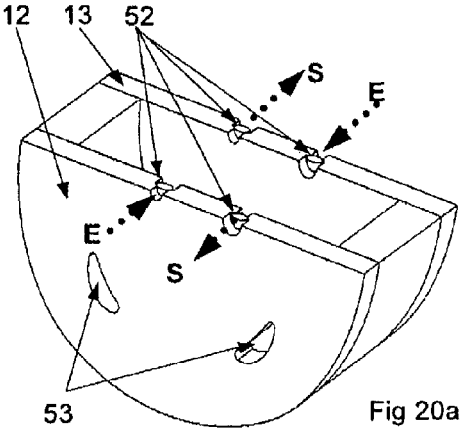
FIG. 20*a* illustrates a transverse section view of a assembly of stator and lateral flanges of the machine.
Figure 20B:
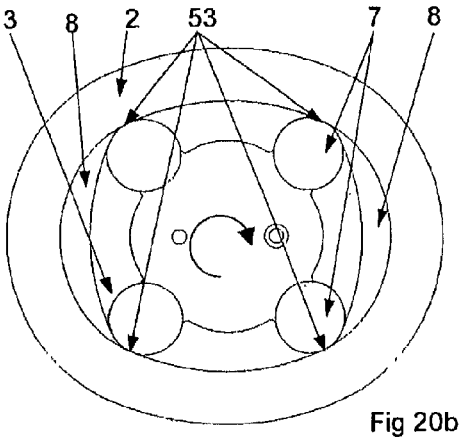
FIGS. 20*b* and 20*c* illustrate section views of the machine of the invention, the rhomb being represented in two different angular positions.
Figure 20C:
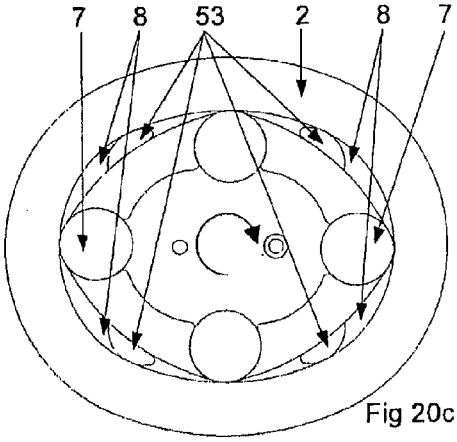

FIGS. 20*a* to 20*c* illustrate orifices formed in the lateral closure flanges 12, 13 of the machine, formed in particular in the form of axial orifices and peripheral ports. As can be seen in FIG. 20*a*, two axial inlet orifices 52 permit an intake of the fluid axially (in the direction of the longitudinal axis of the machine) in the interior of the rotor, these orifices advantageously being able to be provided with check valves ensuring their closure and respectively their opening. The two lateral flanges 12, 13 are likewise each provided with four peripheral ports 53 which are slots having a general half-moon shape, their dimensions and their arrangement being realized such that, at least in one of the positions of the rotor 3, these peripheral ports 53 are completely obstructed by the pivotal hinges 7 of the rotor 3. FIG. 20*b* illustrates such a position in which the four peripheral ports 53 are covered by the four pivotal hinges 7 of the rotor 3. On the rotation of the rotor 3 in the direction indicated by the arrow in FIGS. 20*b* and 20*c*, the peripheral ports 53 are uncovered progressively and the surface of the exchange zone increases with the rotation angle until a position in which they are completely open (FIG. 20*c*), then the section of the fluid exchange zone reduces until the position illustrated in FIG. 20*b*. This solution ensures a progressive and automatic opening and closing of the exchange zone between a fluid circuit upstream or downstream of the machine and the external cavities 8 of the machine, all the closings and openings of orifices being in phase with respect to each other.

Figure 21A:
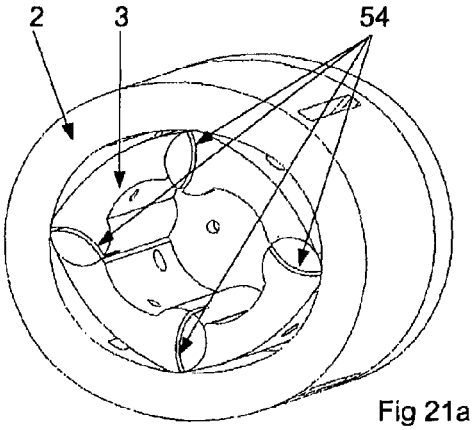
FIGS. 21*a* and 21*b* illustrate simplified perspective views of the machine, the rhomb being represented in two different angular positions.
Figure 21B:
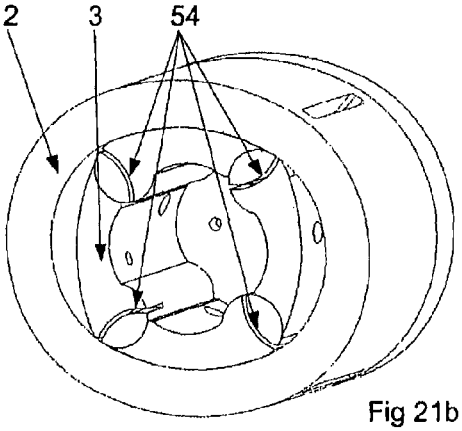

FIGS. 21*a* and 21*b* illustrate another variant embodiment of the exchange zones of fluid in the interior of the machine, in particular via inlet or outlet ducts 54 formed at the level of the pivotal hinges 7 of the rotor 3. The rotation which takes place between the pistons 6 and their pivots 7 allows an automatic opening and closing of these ducts 54 extending radially and over a certain depth along the pivotal hinge 7. It is to be noted that the opening and closing of the ducts belonging to two opposite pivotal hinges (facing each other) are in phase.

Figure 22A:
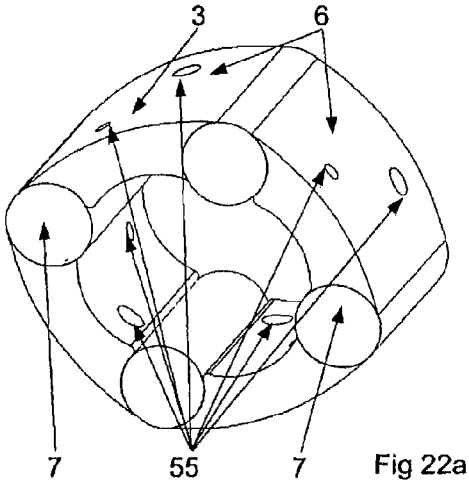
FIGS. 22*a* to 22*c* illustrate simplified perspective views of a deformable rhomb of the invention.
Figure 22B:
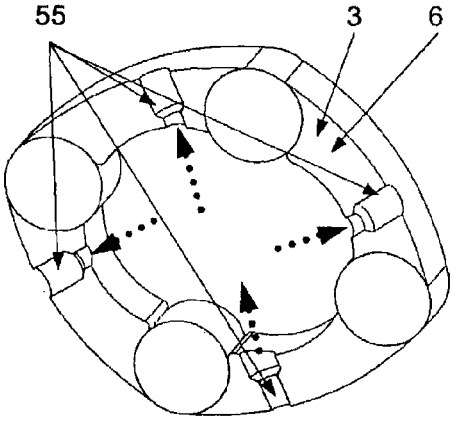
Figure 22C:
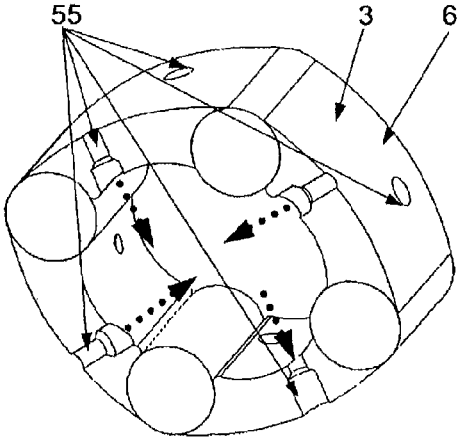

FIGS. 22*a* to 22*c* illustrate another variant embodiment of the exchange zones of fluid, this exchange taking place by ducts 55 formed in a radial direction in the pistons 6. FIG.

22*a* illustrates the rotor 3 of the machine in which each piston 6 comprises two traversing orifices, the passage of fluid being able to be realized in the two directions (interior towards the exterior and vice versa). FIG. 22*b* illustrates an example of a rotor in which each piston comprises a traversing orifice formed so as to be able to receive a closure check valve ensuring the passage of the fluid from the interior towards the exterior (in the direction of the arrows of FIG. 22*b*). FIG. 22*c* illustrates an example similar to the preceding one, but in which the passage of the fluid is permitted from the exterior towards the interior of the rotor (in the direction of the arrows of FIG. 22*c*).

Figure 23:
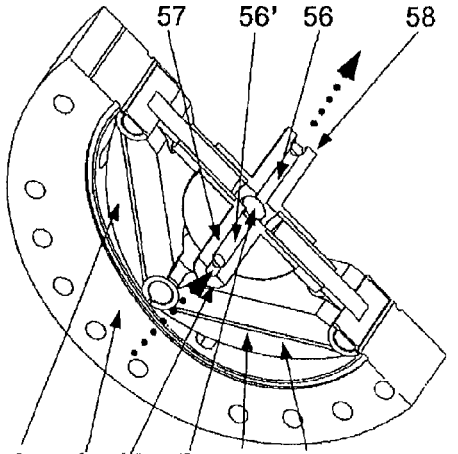
FIG. 23 illustrates a transverse section view of the machine of the invention.

FIG. 23 illustrates another variant embodiment of an axial inlet or outlet duct 56 of fluid, being realized in the central or rotation shaft 57 of the machine. The inner cavity of the rotation shaft 57 comprises a first axial duct 56, the inlet orifice of which is situated at a first end 58 of the shaft and the outlet orifice 59 at the level of the median plane of the machine, and also a second axial duct 56' which departs from this middle plane and goes up to the second end 60 of the rotation shaft 57. Orifices, preferably provided with check valves, permit the intake of the fluid conveyed by the central shaft in the cavities which it passes through, and even the discharge of the fluid from the cavities via the axial duct of the shaft towards an external circuit of the machine.

The fluid inlet and outlet ducts in various cavities of the machine can have sections which are designated free (for example orifices, ports or slots) which are successively obstructed, then opened on rotation of the rotor, or they can be provided with check valves or valves (possibly with a return spring) actuated in opening/closing by a fluid pressure difference, or, in another variant embodiment, they can be provided with closing/opening devices controlled by electric or electromechanical actuators (for example electro-valves, controlled valves, etc. . . . ). Combination of the closing/opening means of the ducts can also be envisaged, for example the said free sections can comprise, in addition, a driven device (such as a rotary shutter with controlled rotation) being able for example to bring about a variation of the surface of the section of the exchange zone.

FIGS. 24 to 28 illustrate a compressor 80 according to the invention, more particularly using two of its external cavities as a water turbine, two of its other external cavities and also several inner cavities as air pumps, each being able to provide different values of the pressure of the air at the outlet, as will be explained below. In this example, the main function of the machine is to turbine water to compress air, the water source being able to be, for example, a running water tap of the conventional distribution network. The ambient air can either be compressed at a pressure greater than that of the water, but with a lower flow, or with a greater flow, but at a lower pressure. The application is a compressor/inflator intended for bicycle wheels, balloons, beach air mattresses, inflatable beds, or others.

Figure 24:
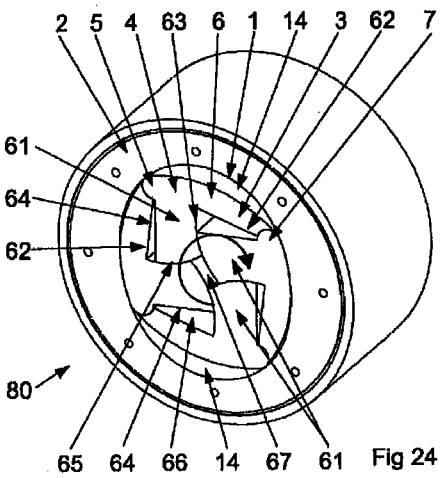
FIG. 24 illustrates a perspective view of another example of embodiment of the invention, the closure flange being removed for greater clarity.

Thus, by way of example, the machine illustrated in FIG. 24 presents two left-hand extrados peripheral cavities 14, two right-hand extrados peripheral cavities 14, four toric cavities 66, and one central cavity 67, which makes an instantaneous total number of 9 cavities, being able to fulfil five functions.

FIG. 24 illustrates a perspective view of the machine, one of the lateral closure flanges having been removed to leave the internal elements of the machine visible. The machine comprises a stator 2, the housing 1 of which receives a rotor 3 with a deformable rhomb 4, the pivotal hinges 7 of which are in contact, with or without clearance, with the internal surface of the housing 1 on the rotation of the rotor 3, this being carried out in the direction indicated by the arrow of FIG. 24. The deformable rhomb 4 comprises four pistons 6 connected to each other by a pivotal hinge 7. Each piston 6 defines an extrados peripheral cavity 14 with the internal surface of the stator 2 and two lateral closure flanges, four extrados peripheral cavities 14 having thus been formed on the exterior of the rotor 3. The four pistons 6 are identical, the intrados of a piston 6 is provided with an excrescence 61 having a general shape of a torus portion, the revolution axis of which is situated in the pivoting axis of a hinge 7 connecting two adjacent pistons 6. More particularly, the intrados of each piston 6 comprises a connection zone 62 of a flat shape, connecting a first right-hand pivotal hinge 7 to the excrescence 61 of the piston 6. The connection zone 62 is extended by an internal zone 63 of concave cylindrical shape extending by a central zone 65 of general convex cylindrical shape connected by an external zone 64 of general flat shape to the left-hand second pivotal hinge 7 of the piston 6. The forms and the dimensions of the zones constituting the intrados of a first piston 6 are realized such that, in operation, each connection zone 62 of this first piston cooperates with an external zone 64 of a second adjacent piston 6 and which is situated to the right with respect to the first, and that each central zone 65 of the first piston cooperates with an internal zone 63 of a third piston, adjacent and situated to the left with respect to the first. These zones cooperate such that, in a predetermined position of the rhomb 4, they can fit and, as the rotation of the rhomb 4 occurs, they can move apart and move close and thus form variable-volume inner cavities for the reception of a fluid. As better visible in FIGS. 24 and 28*c*, the zones of the intrados of the pistons 6 thus define five variable-volume inner cavities, four of which being toric cavities 66 and one a central cavity 67.

In FIGS. 24 to 28, the left-hand part of the extrados peripheral cavities 14 of the machine, more particularly two adjacent extrados peripheral cavities 14, is used as a water turbine, this being a motor function of the machine. The right-hand part of the extrados peripheral cavities 14 of the machine, more particularly the two other adjacent extrados peripheral cavities 14, is used as a low pressure air pump. The toric cavities 66 are used as a medium pressure air pump. The central cavity 67 is used as a high pressure air pump.

The management of the transfer of compressed air between the different cavities is carried out via valves: when the need for pressure is low, one wishes to use the different pumps (constituted by the right-hand part, the toric cavities and the central cavity) in parallel; or else, when need for pressure is great, the pumps are used in series.

The machine is autonomous and operates without a mechanical transmission shaft. Indeed, there is a balance between the energy provided by the turbined fluid and the compressed gas.

Figure 25:
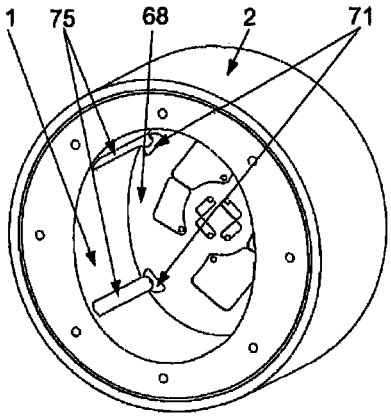
FIG. 25 illustrates the stator of the machine of FIG. 24.
Figure 26:
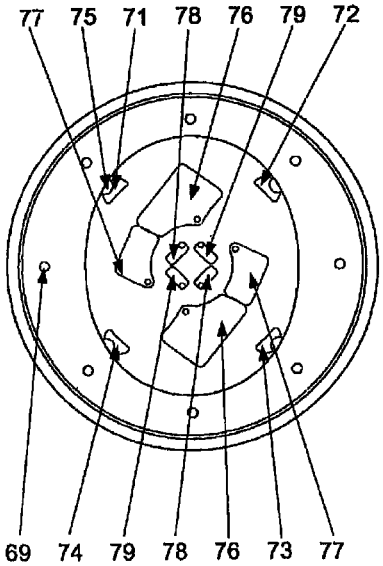
FIG. 26 is a front view of the stator of FIG. 25.
Figure 27:
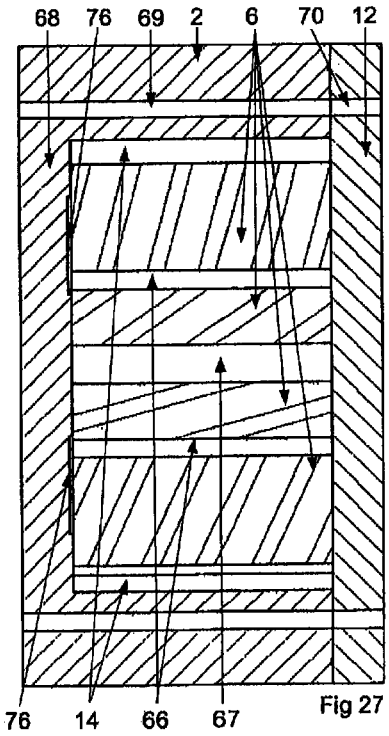
FIG. 27 is an axial section view, on an enlarged scale, of the machine of FIG. 24, comprising the closure flange.

The stator 2, the lateral closure flange 12 and the different fluid inlet and outlet zones in the machine are better visible in FIGS. 25 to 27. The stator 2 is a vessel comprising a bottom wall 68, its housing 1 being closed by a lateral flange 12. The stator 2 is closed by the flange 12 by means of fixing screws passing through the passages 69 formed on the periphery of the stator 2 and of the lateral flange 12. The bottom wall 68 of the stator comprises four hollow cells arranged on the periphery and having a half-moon shape and each extending by a radial axial duct 75 opening out in an extrados cavity 14. The bottom wall 68 comprises: a half-moon air inlet 71, a half-moon air outlet 72, a half-moon water inlet 73 and a half-moon water outlet 74.

The bottom wall 68 further comprises, at the level of the zone covered by the rotor, four distribution plates, of which two are air inlet plates 76 in the toric cavities 66 and two are air outlet plates 77 in the toric cavities 66. The bottom wall 68 also comprises, in its central zone, two air inlet recesses 79 and two air outlet recesses 78 cooperating with the central cavity 67. The connections with fluid circulation ducts (pipes, connection hoses, etc.) are represented by circles (better visible in FIG. 26) in the interior of each inlet zone, or respectively outlet zone of the wall 68.

The operating of the compressor will now be explained with reference to FIGS. 28*a* to 28*d*.

Figure 28A:
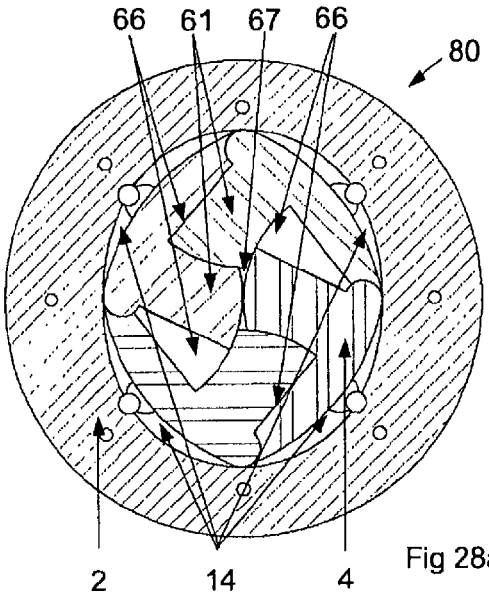
FIGS. 28*a* to 28*d* illustrate the evolution of the cavities of the machine of FIG. 24 on a complete cycle of the rhomb.

FIG. 28*a* illustrates the compressor 80 in the most squashed position of the rhomb 4, two opposite toric cavities 66 are at their maximum volume and the two others at their minimal volume, the central cavity 67 is at its minimal volume and the extrados peripheral cavities 14 are in an intermediate position.

Figure 28B:
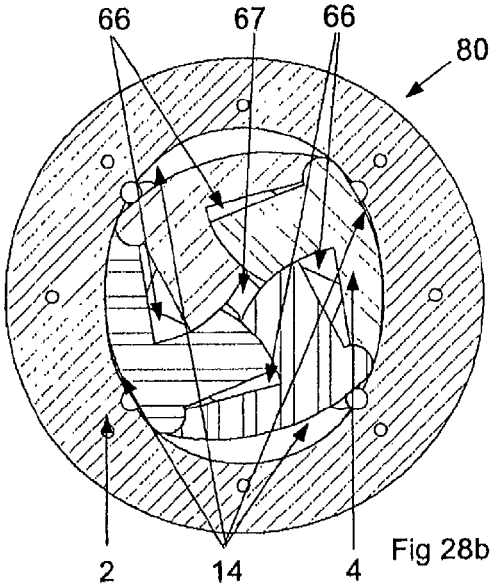

FIG. 28*b* illustrates the compressor 80 in the position in which the rhomb 4 tends towards the shape of a square. In this phase, the toric cavities 66 start the discharging of the air (to the left and to the right) and the aspiration (top and bottom). The central cavity 67 starts to aspirate and the extrados peripheral cavities 14 are at the end of aspiration (top and bottom) and at the start of discharging (to the left and to the right).

Figure 28C:
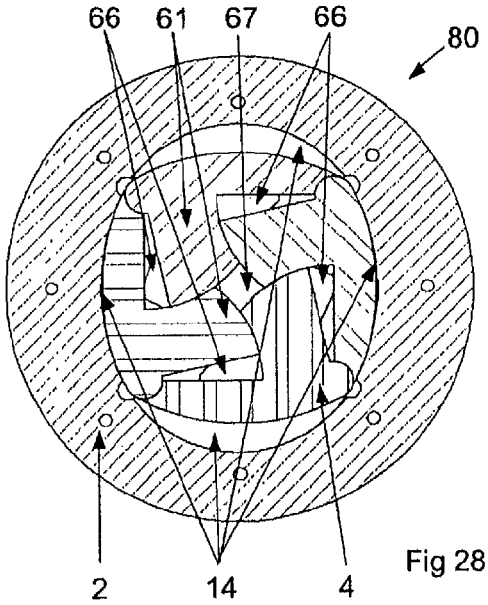

FIG. 28*c* illustrates a following phase of the rotation of the rhomb, this having taken the shape of a square, in which the toric cavities 66 continue the aspiration of the fluid (top and bottom) and the discharging (to the left and to the right), the central cavity 67 has reached is maximum volume and the extrados peripheral cavities 14 have finished the aspiration (top and bottom) and the discharging (to the left and to the right).

Figure 28D:
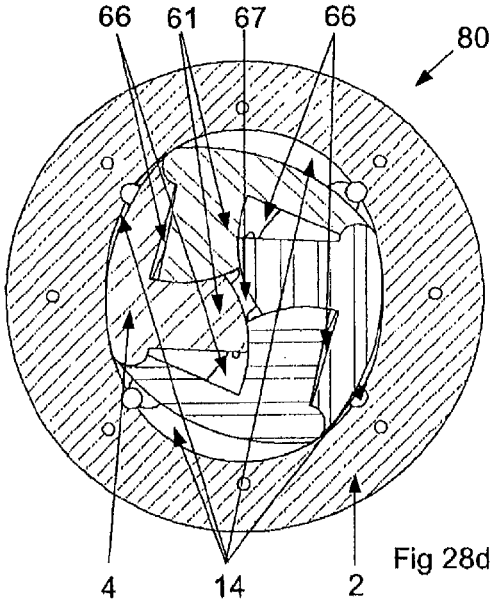

FIG. 28*d* illustrates a following phase in which the toric cavities 66 finish the aspiration of the fluid (top right and bottom left) and the discharging (top left and bottom right), the central cavity 67 is in full discharging and the extrados peripheral cavities 14 start the discharging (top and bottom) and the aspiration (to the left and to the right).

An example of the use of such a compressor 80 is when it receives, at the inlet, power by turbining the water of the conventional supply network and it forwards, at the outlet, compressed air. The flow of water received, of a value of approximately 10 L/min, is turbined by a pressure of 2 bar absolute at atmospheric pressure (an operation at standard pressure of the network of 3 bars relative is also possible). For this, the machine uses two of the four peripheral cavities 14 (top left and top right) which are formed by the extrados of the piston 6 and the internal surface of the stator 2. The other cavities are used for the pumping of the air. The power received by the machine is then absorbed by the different integrated pumps which compress the air of the atmospheric pressure to the downstream pressure. So as to optimize the operation of the machine, the different pumps will be loaded or bypassed according to the pressure needs downstream of the machine.

The balance between the power received and the power consumed is made without a drive shaft. Indeed, if the pressure need is low (start of inflation, the pressure is essentially due to the losses of loads), then all the pumps will be loaded and the flow is maximum. The flow of all the pumps is then approximately 30 NL/min (normal liters per minute), that is: 10 NL/min for the extrados cavities 14 reserved for the pumping of the air, 16 NL/min for the toric cavities 66 and 4 NL/min for the central cavity 67, for an overpressure going up to 0.3 bar.

If the delivered pressure becomes insufficient (progressive pressurization of the volume to be inflated), the toric cavities 66 are bypassed and the flow reduces to the benefit of the pressure. The flow of the whole of the pumps is then approximately 14 NL/min (10 NL/min for the extrados peripheral cavities 14 reserved for the pumping of the air and 4 NL/min for the central cavity 67) for an overpressure going up to 0.6 bar.

Finally, the inflation at maximum pressure is carried out by also short-circuiting the extrados peripheral cavities 14 of the pump, so as to only keep the water turbine and the central cavity 67. The flow of the central cavity 67 is approximately 4 NL/min for an overpressure going up to 2 bar, that is: approximately 3 bar absolute.

When the rhomb is in the particular configuration in which it forms a square (FIG. 28*c*), the machine is at a dead point. To make this position unstable, one can use an actuating device (such as a device with springs arranged between two connected pistons or with magnets integrated in the pistons) so as to promote the displacement towards the most squashed position of the rhomb.

The technical characteristics of the machine are given below by way of example. The machine has a very compact size. Indeed, the length (according to the large axis of the transverse section of the stator) is approximately 70 mm, the width (according to the small axis of the transverse section of the stator) is approximately 60 mm and the depth (according to the longitudinal axis) is approximately 40 mm.

An improved, more compact and lighter machine can be conceived for higher rotation speeds, whilst providing it with tightness systems at the level of its fluid exchange zones. Conversely, it is also possible to envisage a larger dimensioning of the machine, when one makes the pistons heavier so as to increase the moment of inertia of the rhomb around the axis of rotation.

By way of indication, the dimensional and geometric tolerances are in the order of a hundredth of a mm so as to limit leakages. The maximum volume of an extrados peripheral cavity 14 is approximately 5 $cm^3$, that of a toric cavity 66 is approximately 4 $cm^3$ and that of the central cavity 67 is 2 $cm^3$. The dead volume of an extrados peripheral cavity 14 is negligible and depends essentially on the inlet and outlet ducts, namely approximately 0.1 $cm^3$ for a duct of the air pump and 1 $cm^3$ for a duct of the water turbine. The dead volume of a toric cavity 66 is negligible and also depends essentially on the inlet and outlet ducts, namely approximately 0.1 $cm^3$. Finally, the central cavity 67 has a dead volume which also depends on the shape of the cavity, but which can be reduced to approximately 0.2 $cm^3$. The machine is tight with respect to the exterior because static tightnesses satisfy its needs (without relative movement of parts). The internal tightnesses of the machine are essentially formed by the reduced clearances, large leakage throttling zones and the use of deformations of the parts under pressure to reduce the clearances and improve the tightness.

Based on the above dead volume information and examples of cavity volume, it is possible to calculate the following ratio: dead volume/capacity of inner cavity. Indeed, as will be appreciated by the skilled artisan, capacity (of a cavity) (maximum volume of the cavity)−(dead volume). For an inner cavity of 4 $cm^3$, the capacity of the cavity is therefore (a) 3.9 $cm^3$ for a dead volume of 0.1 $cm^3$ (3.9 $cm^3$=4 $cm^3$−0.1 $cm^3$), or (b) 3.8 $cm^3$ for a dead volume of 0.2 $cm^3$ (3.8 $cm^3$=4 $cm^3$−0.2 $cm^3$) or (c) 3 $cm^3$ for a dead volume of 1 $cm^3$ (3 $cm^3$=4 $cm^3$−1 $cm^3$).

Accordingly, for an inner cavity of 4 $cm^3$ and dead volumes of 0.1 $cm^3$, 0.2 $cm^3$ or 1 $cm^3$, the ratio dead volume/capacity is equal to (a) 0.026 or 2.6% (0.026=0.1/3.9) or (b) 0.053 or 5.3% (0.053=0.2/3.8) or (c) 0.33 or 33% (⅓). The same calculation can be obtained for a cavity of 2 $cm^3$. Specifically, for an inner cavity of 2 $cm^3$, the capacity of the cavity is 1.8 $cm^3$ for a dead volume of 0.2 $cm^3$ (1.8 $cm^3$=2 $cm^3$−0.2 $cm^3$). Accordingly, for an inner cavity of 2 $cm^3$ and a dead volume of 0.2 $cm^3$, the ratio dead volume/capacity is equal to (a) 0.11 or 11% (0.11-02/1.8). Furthermore, as explained previously, the dead volume can be about zero. In that case, the ratio dead volume/capacity is 0. Accordingly, the geometry of the plurality of pistons defining the closed chain forms a dead volume in the inner cavity that may be equal to or lower than 33% of a capacity of the internal cavity (for example, 0%, 2.6%, 5.3%, 11% or 33%).

The machine can be realized by means of plastic materials with a low coefficient of friction to ensure the lightness of the assembly, as the pressure is low and the parts have a very robust design.

The machine can withstand the problems of the presence of water in the air pumps, owing in particular to the dead volumes, the latter serving as pneumatic absorbers to avoid the hydraulic shock on reduction of volume. In addition, in the case of a large excess of liquid in the pneumatic zones, the pressure increasing greatly, the pistons and the flanges deform to free a passage for the fluid.

In the described example, the compressor 80 is designed to turn at 500 rpm for a flow of water of 10 L/min. This speed, although low, ensures the continuity of the movement and the passage of the dead points easily.

The machine can operate with water at a temperature comprised between 10 and 60° C., in ambient air between 10 and 50° C. and with very polluted air or water (large size and concentration of particles, being able to contain, for example, particles of sand), the machine being equipped with filters upstream of the supply with water and upstream of the supply with air, allowing the filtering of the particles in these fluids having a size greater than 20 microns.

The passage of the water in the device to be inflated is avoided owing to a small vertical pipe directed upwards immediately at the exit of the machine. This device allows the droplets of water present in the air to fall, but does not impede the passage of the air. This portion of pipe can be connected to the water inlet to empty this pipe automatically. This pipe is not represented in the figures; likewise the short-circuiting systems are not represented.

The machine illustrated in FIGS. 24 to 28 can also operate as a compressor with several compression stages. Thus, when a compressor function is to be fulfilled in several compression stages, in particular to promote the efficiency, a RMDR machine according to the invention, having an exterior diameter of 250 mm and a depth of 140 mm (according to the longitudinal axis of the machine), can admit capacities per turn of 1,022 $cm^3$ for the first compression stage, 680 $cm^3$ for the second compression stage and 102 $cm^3$ for the third compression stage, of the same fluid passing successively through the extrados peripheral cavities 14, the toric cavities 66 then the central cavity 67. Such a three-stage compressor (or multi-compressor) according to the invention has a volume of space of 6,872 $cm^3$.

Now, a device composed of 3 RMDR machines known from the prior art, each operating as a compressor to fulfil individually one of the three compression functions of the three-stage machine, having identical capacities per turn but only using the external cavities, would have a bulk volume of 14,120 $cm^3$, if it was realized according to construction characteristics similar to the three-stage RMDR compressor of the invention. Thus, the RMDR machine according to the invention, integrating three compression functions in the same rotor, has a power density 2.05 times greater than a device composed of three RMDR machines known from the prior art.

Consequently, the implementation of several different RMDR machines, as known in the prior art, to realize a function (for example compression or expansion on a compressible fluid), when this function must necessarily be segmented in several successive functions of the same nature, owing to the large extent of the variation of at least one of the parameters of the fluid (typically for pressure ratios greater than 10) or for an aim of improving the efficiency, can from now be realized by a single RMDR machine according to the invention. Advantageously, the invention provides responses in numerous applications, in particular applications known as mobile or on-board applications, which have as the prime technical criteria the reduction of the overall dimensions and/or of the mass.

Another example application of the machine of the invention, the structure of which is illustrated in FIGS. 24 to 28 is described below. This is an autonomous converter of hydraulic energy into pneumatic energy, without transmission. It can ensure the local production of compressed air without recourse to a compressor. This functionality is very pertinent at the end of a hydraulic power shovel jib on which one wishes to install a pneumatic shock system.

Thus, at the inlet of the machine, oil under high pressure fills the cavities 66. The pressure of the oil drives the rotor in rotation. The oil leaves the cavities 66 of the machine again at a reduced pressure, less than that on entry. The cavities 66 turbine the oil.

Air at ambient pressure is admitted in the cavities 14. The rotation of the rotor causes the reduction of the volume of the cavities 14 and the compression of the gas which they contain. The air, which is thus compressed, is discharged in the cavity 67 via an intermediate air circuit. The compressed air, discharged through the cavities 14, is admitted in the cavity 67. The rotation of the rotor causes the reduction of the volume of the cavity 67 and the compression of the gas which it contains. The air, which is thus supercompressed, is discharged at the destination of the application.

The oil ensures a tightness barrier between the two compression stages.

A pneumatic application in a closed circuit avoids the pollution of the air. It is very easy to separate the oil and the air and to reintegrate the oil in the circuit via an automatic purge system. The air in a small quantity in the oil does not constitute a pollutant for the oil and does not involve major consequences, because the air will separate from the oil on decanting in the reservoir.

Moreover, the machine which is thus realized does not require a mechanical transmission shaft. The power generated by the turbining of the oil is absorbed by the compression of the air. The turbining and the compression are simultaneous (operation in parallel), whereas the two compression stages are carried out successively (for an operation in series).

Other variants and embodiments of the invention can be envisaged without departing from the framework of the invention as delimited in the claims.

The invention claimed is:

1. A deformable rhombus rotary machine, comprising:

a stator defining a housing having an oval section;

a central shaft having an oval section centered in the housing; and four similar shaped pistons connected to each other by pivotal links having parallel axes, forming a deformable rhombus rotor, each of the four similar shaped pistons having a surface external to the rhombus cooperating with a wall of the housing for defining a variable volume external cavity, and a surface internal to the rhombus cooperating with the central shaft for defining a variable volume internal cavity;

wherein each of the four similar shaped pistons is configured so that the pivotal links are continuously in contact with both the wall of the housing and the central shaft throughout one revolution of the rotor.

2. The rotary machine of claim 1, wherein the surface internal to the rhombus of each of the four similar shaped pistons is configured to fit over an external surface of the central shaft where the external surface of the central shaft is most remote from the center of the central shaft.

3. A deformable rhombus rotary machine, comprising:

a stator defining a housing having a circular section;

a central shaft having an oval section centered in the housing; and four similar shaped pistons connected to each other by pivotal links having parallel axes, forming a deformable rhombus rotor, each of the four similar shaped pistons having a surface external to the rhombus cooperating with a wall of the housing and the external surfaces of two adjacent pistons of the four similar shaped pistons for defining two variable volume external cavities, and a surface internal to the rhombus cooperating with the central shaft for defining a variable volume internal cavity;

wherein the external surface of each of the four similar shaped pistons is configured so that a central portion of the external surface is continuously in contact with the wall of the housing throughout one revolution of the rotor.

4. The deformable rhombus rotary machine of claim 3, wherein:

the four similar shaped pistons are configured so that the pivotal links are continuously in contact with the central shaft throughout one revolution of the rotor.

5. The rotary machine of claim 3, wherein the surface internal to the rhombus of each piston of the four similar shaped pistons is configured to fit over an external surface of the central shaft at each half-revolution of the rotor, in positions where the external surface of the central shaft is most remote from the center of the central shaft.

6. A deformable rhombus rotary machine, comprising:

a stator defining a housing having an oval section;

a central shaft having a circular section centered in the housing; and four similar shaped pistons connected to each other by pivotal links having parallel axes, forming a deformable rhombus rotor, each of the four similar shaped pistons having a surface external to the rhombus cooperating with a wall of the housing for defining a variable volume external cavity, and a surface internal to the rhombus cooperating with the central shaft and the internal surface of an adjacent piston for defining a variable volume internal cavity;

wherein the four similar shaped pistons are configured so that the pivotal links are continuously in contact with the wall of the housing throughout one revolution of the rotor, and the surface internal to the rhombus of each of the four similar shaped pistons comprises two symmetrical cylindrical sectors portions, and configured so that an intersection zone between the two symmetrical cylindrical portions is continuously in contact with the central shaft.

7. The rotary machine of claim 6, wherein the surface internal to the rhombus of each piston of the four similar shaped pistons is configured so that each of the two symmetrical cylindrical portions fits over an external surface of the central shaft once during each half-revolution of the rotor.

8. A deformable rhombus rotary machine, comprising:

a stator defining a housing having an oval section; and four similar shaped pistons connected to each other to form together a deformable rhombus rotor, and each of the four similar shaped pistons having a surface external to the rhombus cooperating with a wall of the housing for defining a variable volume external cavity, and a surface internal to the rhombus comprising an excrescence configured to slide in contact with the excrescences of two adjacent pistons of the four similar shaped pistons to define two variable volume internal cavities.

9. The rotary machine of claim 8, wherein each of the excrescences comprises:

a zone of convex cylindrical shape; and a zone of concave cylindrical shape adjacent the zone of convex cylindrical shape;

wherein each of the zones of convex cylindrical shape is configured to slide in contact with the zone of concave cylindrical shape of one of the two adjacent pistons of the four similar shaped pistons.

* * * * *